US008443777B2

(12) United States Patent
Enokida

(10) Patent No.: US 8,443,777 B2
(45) Date of Patent: May 21, 2013

(54) OIL PAN

(75) Inventor: Satoshi Enokida, Hiroshima (JP)

(73) Assignee: DaikyoNishikawa Corporation, Aki-gun, Hiroshima (JP)

( * ) Notice: Subject to any disclaimer, the term of this patent is extended or adjusted under 35 U.S.C. 154(b) by 499 days.

(21) Appl. No.: 12/641,930

(22) Filed: Dec. 18, 2009

(65) Prior Publication Data

US 2010/0162988 A1 Jul. 1, 2010

(30) Foreign Application Priority Data

Dec. 26, 2008 (JP) ..... 2008-332952
Jan. 26, 2009 (JP) ..... 2009-014228
Jan. 27, 2009 (JP) ..... 2009-015467

(51) Int. Cl.
*F02B 77/00* (2006.01)

(52) U.S. Cl.
USPC ..... 123/195 C; 184/106

(58) Field of Classification Search ..... 123/195 C, 123/196 R, 198 E, 195 H; 184/106, 6.5
See application file for complete search history.

(56) References Cited

U.S. PATENT DOCUMENTS 4,683,850 A * 8/1987 Bauder ..... 123/195 C
4,770,276 A * 9/1988 Takubo ..... 184/106
4,848,293 A * 7/1989 Sasada et al. ..... 123/195 C
4,898,261 A * 2/1990 Winberg et al. ..... 184/6.22
5,388,556 A * 2/1995 Angus et al. ..... 123/195 C
5,469,822 A * 11/1995 Mechsner ..... 123/195 C
5,664,537 A * 9/1997 Beranek et al. ..... 123/195 C
6,131,543 A * 10/2000 Achenbach et al. ..... 123/195 C
7,240,657 B2 7/2007 Watanabe
7,748,500 B2 * 7/2010 Nagano et al. ..... 184/106
2006/0288976 A1 12/2006 Watanabe
2008/0264727 A1 10/2008 Nagano et al.

FOREIGN PATENT DOCUMENTS

JP 02108804 A * 4/1990
JP 02-264109 10/1990
JP 4-132445 12/1992
JP 5-179991 7/1993
JP 09-014049 1/1997
JP 2003-222012 8/2003
JP 2006-242052 9/2006
JP 2006-283617 10/2006
JP 2007-009738 1/2007
JP 2008-274793 11/2008

* cited by examiner

*Primary Examiner* — Noah Kamen
*Assistant Examiner* — Hung Q Nguyen
(74) *Attorney, Agent, or Firm* — Nixon Peabody LLP; Jeffrey L. Costellia

(57) ABSTRACT

An oil pan made of resin includes an oil reservoir. The oil reservoir includes a bottom wall and a peripheral wall rising from a periphery of the bottom wall and having an opening at a top of the oil reservoir. A rib is provided in the oil reservoir.

15 Claims, 23 Drawing Sheets

OIL PAN

BACKGROUND

1. Technical Field

The present disclosure relates to oil pans made of resin.

2. Background Art

Conventional power units such as engines and automatic transmissions are provided with oil pans for temporarily reserving oil circulated in the power units (see, for example, Japanese Patent Publications Nos. 2-264109 and 2006-283617). An oil pan described in Japanese Patent Publication No. 2-264109 includes an oil reservoir having a bottom wall and a peripheral wall rising from the periphery of the bottom wall. An opening through which oil circulated in a power unit flows into the oil reservoir is formed at the top of the oil reservoir. A plurality of ribs and a fastening portion fastened to the power unit are provided in the oil reservoir, and are located closer to the outside than the opening of the oil reservoir.

An oil pan described in Japanese Patent Publication No. 2006-283617 is formed out of a resin material, and includes an oil reservoir having an opening located in an upper portion thereof.

Further, in an oil pan described in Japanese Patent Publication No. 2003-222012, an oil pan separator is provided in the oil pan to divide an oil reservoir into a main chamber and a sub-chamber such that oil which has circulated in the power unit and returned to the oil reservoir flows into the main chamber (where this oil will be referred to as return oil hereinafter), and that the oil in the main chamber is sucked. With this configuration, when the oil has high viscosity immediately after a cold start, relatively warm return oil which has flown in the main chamber circulates in each part of the power unit, and the temperature of the oil in the main chamber is increased at an early stage, thereby reducing the viscosity thereof. Consequently, friction can be reduced, resulting in reduction of energy consumption.

However, the oil pan of Japanese Patent Publication No. 2006-283617 is formed out of a resin material. Accordingly, the oil pan can have a lighter weight than a steel-made oil pan, but might have insufficient rigidity. In particular, the presence of the opening in the oil reservoir considerably reduces rigidity. Insufficient rigidity of the oil pan might cause each part of the oil pan to easily vibrate with vibration of the power unit, thereby producing noise. In addition, deformation and damage are likely to occur upon application of external forces.

To solve the foregoing problems, a technique of providing a rib for reinforcement as described in Japanese Patent Publication No. 2-264109, is conceivable. However, this rib is provided outside the opening of the oil reservoir, and thus the outer size of the oil pan increases to an extent corresponding to the area of the rib. In addition, even if the rib is provided outside the opening, the opening is still large, and thus considerable reinforcement cannot be expected.

Further, an oil strainer is provided in the oil pan, and various components are provided outside the oil pan in some cases. Thus, the shape of the oil pan needs to be adjusted so as to prevent interference among these components. Moreover, the bottom wall of the oil pan needs to be shaped to allow oil reserved therein to be guided to a suction port of the oil strainer. For these reasons, the shape of the oil pan tends to be complicated.

If such an oil pan is to be formed as one piece made of resin, as described in Japanese Patent Publication No. 2006-283617, the resultant structure thereof is very complicated, and in some cases, oil pan intended to have some shapes cannot be formed.

The oil pan of Japanese Patent Publication No. 2003-222012 includes an additional oil pan separator in order to divide the oil reservoir into a main chamber and a sub-chamber. In this oil pan, the number of parts constituting the oil pan increases, leading to an increase in cost.

It is therefore a first object of the present disclosure is to obtain a compact structure ensuring high rigidity by devising ribs in a resin oil pan.

A second object of the present disclosure is to ensure high rigidity while forming an oil pan of a resin material even when the oil pan is intended to have a complicated shape.

A third object of the present disclosure is to reduce cost by dividing an oil reservoir into a main chamber and a sub-chamber, while enhancing rigidity of the resin oil pan without an increase in the number of parts of the oil pan.

SUMMARY

To achieve the first object, in a first aspect of the present disclosure, an oil pan made of resin includes: an oil reservoir including a bottom wall and a peripheral wall rising from a periphery of the bottom wall and having an opening at a top of the oil reservoir; and a rib provided in the oil reservoir. The rib extends across the opening in plan view to join portions of the peripheral wall which are separated from each other along a periphery of the peripheral wall.

In the first aspect, the rib extends across the opening in plan view to join portions of the peripheral wall which are separated from each other along a periphery of the peripheral wall. Accordingly, the rib can sufficiently increase rigidity of portions near the opening which otherwise decreases easily, and vibration of each part of the oil pan can be reduced, thereby reducing noise. Since the rib extends across the opening of the oil reservoir in the manner described above, it is possible to dispose the rib by effectively utilizing the space in the opening, while hardly changing the outer shape of the oil pan. As a result, the oil pan with the rib can be made compact with high rigidity achieved with effective arrangement of the rib.

The oil pan may further include a fastening portion configured to fasten the oil pan and located in a portion of the peripheral wall near the opening of the oil reservoir, and the rib may extend from a portion near the fastening portion.

In this case, since the rib extends from a portion near the fastening portion, it is possible to increase strength of the fastening portion by utilizing the rib.

The oil pan may further include multiple ones of the fastening portion, wherein the multiple ones of the fastening portion are spaced apart from each other along the periphery of the peripheral wall, and the rib joins portions near the multiple ones of the fastening portion.

In this case, the ribs join portions near the fastening portions to each other, thereby further increasing strength of the portions near the fastening portion.

The oil pan may further include first, second, and third ribs joining portions near the multiple ones of the fastening portion, and the first, second, and third ribs may intersect each other.

In this case, the first, second, and third ribs joining portions near the fastening portions intersect each other. Accordingly, when a force is applied to the first rib, for example, this force is distributed to the second rib and the third rib. As a result, deformation and damage of the oil pan can be reduced.

The oil pan may further include multiple ones of the rib, wherein the multiple ones of the rib intersect each other to form at least one triangle in plan view.

In this case, since a plurality of ribs intersect each other to form at least one triangle in plan view, the oil pan is less likely to be deformed by a force applied to the side of the peripheral wall, thereby further increasing rigidity.

The rib may be continuous to the bottom wall of the oil reservoir.

In this case, since the rib is continuous to the bottom wall of the oil reservoir, the rib can join the bottom wall and the peripheral wall together, thereby further increasing rigidity of the oil reservoir.

To achieve the second object, in a second aspect of the present disclosure, an oil pan includes a first part and a second part which are made of resin and are formed as one piece, wherein the first part includes a first rib, and the first rib is joined to the second part.

In this aspect, the first part and the second part can be formed independently of each other. Accordingly, even if the shape of the oil pan is intended to be complicated, the parts can be easily formed as compared to a case where the parts are formed as one piece, and thus good formability can be obtained. The first part is reinforced by the first rib, and has its rigidity increased. The first rib of the first part having the thus-increased rigidity is joined to the second part, thereby firmly uniting the first part and the second part. At the same time, rigidity of the second part can also be enhanced, resulting in that rigidity of the entire oil pan made of resin and intended to have light weight can be increased.

The second part may include a second rib, and the second rib may be joined to the first part.

In this case, the second rib can increase rigidity of the second part, and joining of the second rib to the first part allows the first part and the second part to be more firmly joined.

The oil pan may include an oil strainer including a filter element for filtering oil, and a filter-element housing configured to house the filter element and having a suction port for sucking oil and a discharge port for discharging oil which has passed through the filter element, wherein the filter-element housing includes the first rib and the second rib.

In this case, the oil strainer can be provided as one piece with the oil pan. In addition, since the filter-element housing of the oil strainer is formed by utilizing the first rib and the second rib, the structure of the oil pan can be simplified, and the weight of the oil pan can be reduced, as compared to a case where the filter-element housing is provided as an additional part.

The first part may have a fastening portion configured to fasten the oil pan, and the first rib may extend from a portion near the fastening portion.

In this case, since the first rib extends from a portion near fastening portion, rigidity of the fastening portion can be increased.

The first part may form an upper portion of the oil pan, the second part may form a portion of the oil pan including a bottom wall of the oil pan, and the first rib may extend vertically in a vertical direction, and be joined to a bottom wall of the second part.

In this case, since the first rib is joined to the bottom wall of the second part, the bottom wall of the oil pan can be reinforced.

To achieve the third object, in a third aspect of the present disclosure, an oil pan made of resin includes: an oil reservoir including a bottom wall and a peripheral wall rising from a periphery of the bottom wall and having an opening at a top of the oil reservoir; and a rib provided in the oil reservoir, wherein the rib divides an inside of the oil reservoir into a main chamber having a suction port for sucking oil and a sub-chamber.

In this case, the rib in the oil reservoir can increase rigidity of the oil pan. In addition, since the rib divides the inside of the oil reservoir into the main chamber and the sub-chamber, it is unnecessary to provide an additional oil pan separator. Accordingly, the number of components of the oil pan can be reduced, thereby reducing cost.

The rib may have a through hole configured to establish communication between the main chamber and the sub-chamber.

In this case, oil in the sub-chamber can flow into the main chamber through the through hole of the rib. Accordingly, only forming the through hole in the rib can easily obtain a structure for establishing communication between the main chamber and the sub-chamber.

The oil pan may include a first part and a second part which are formed as one piece, the rib may be provided in each of the first part and the second part, and a gap for establishing communication between the main chamber and the sub-chamber may be formed between the rib of the first part and the rib of the second part.

In this case, since the oil pan is divided into the first part and the second part, good formability can be obtained even if the oil pan is intended to have a complicated shape. In addition, since a gap for establishing communication between the main chamber and the sub-chamber is formed between the rib of the first part and the rib of the second part, a structure for establishing communication between the main chamber and the sub-chamber can be easily obtained.

The oil pan may further include an oil strainer provided in the main chamber, wherein the oil strainer includes a filter element and a filter-element housing configured to house the filter element, and the filter-element housing is constituted by the rib.

In this case, the oil strainer can be provided as one piece with the oil pan. Since the filter-element housing of the oil strainer is formed by utilizing the rib, the oil pan can have lighter weight than in a case where the filter-element housing is made of an additional part.

The oil pan may further include an oil strainer in addition to the oil reservoir, and the oil strainer may have a fixing portion to be fixed to the rib.

In this case, the oil strainer provided independently of the oil reservoir can be fixed to the rib. That is, the rib can also be used for fixing the oil strainer.

The main chamber may have a bottom including an outer wall and an inner wall.

In this case, the bottom of the main chamber has a multiple structure made of the outer wall and the inner wall, thereby enhancing heat insulating properties. Accordingly, in particular, oil in the main chamber is less likely to be cooled by cold outside air in a cold state, and thus the temperature of oil sucked into the power unit can be increased quickly, thereby reducing viscosity. As a result, energy consumption can be reduced.

DETAILED DESCRIPTION

Embodiments of the present disclosure will be described in detail hereinafter with reference to the drawings. The following embodiments are merely examples in nature, and are not intended to limit the scope, applications, and use of the invention.

Embodiment 1

Figure 1:
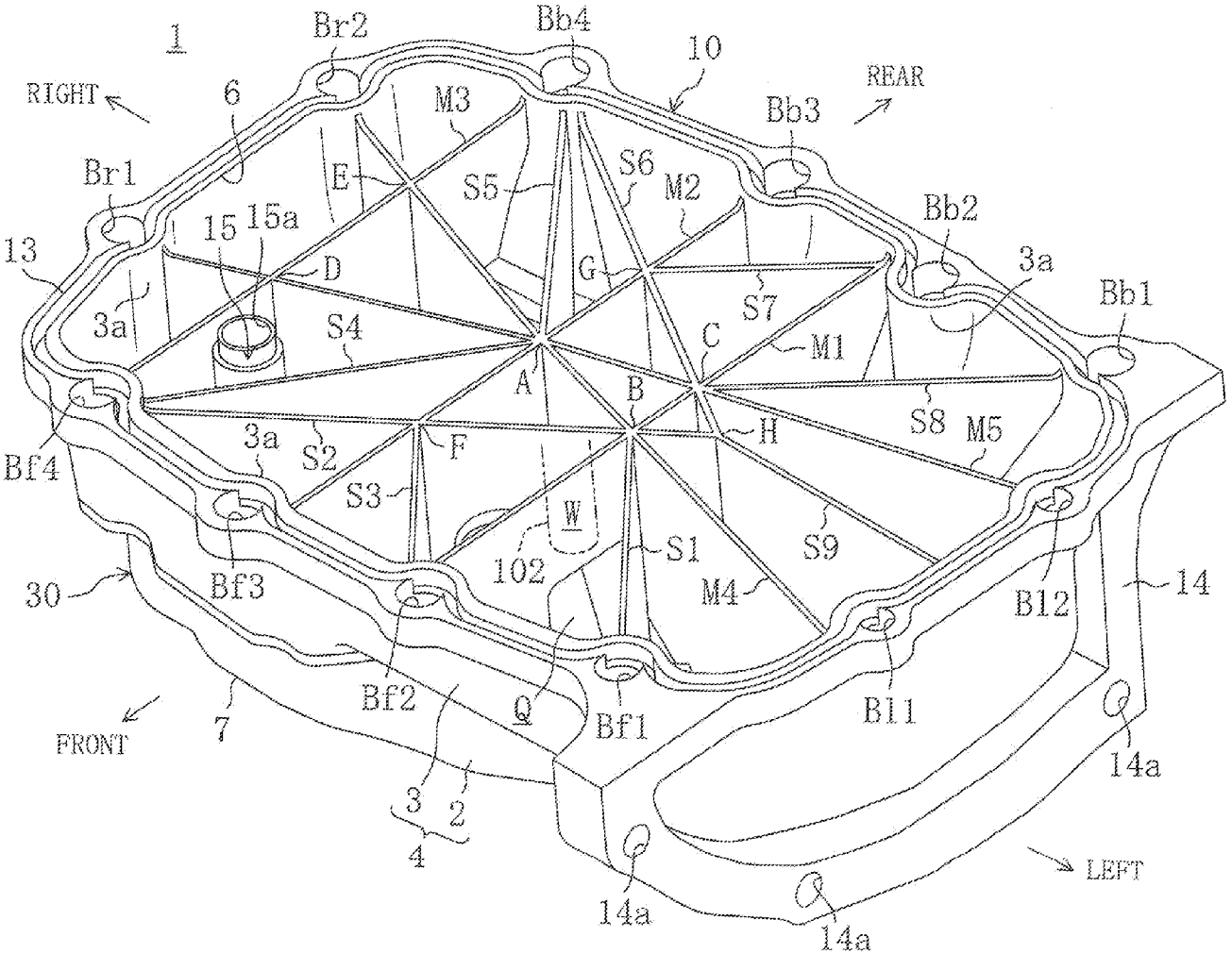
FIG. 1 is a perspective view of an oil pan according to a first embodiment.
Figure 2:
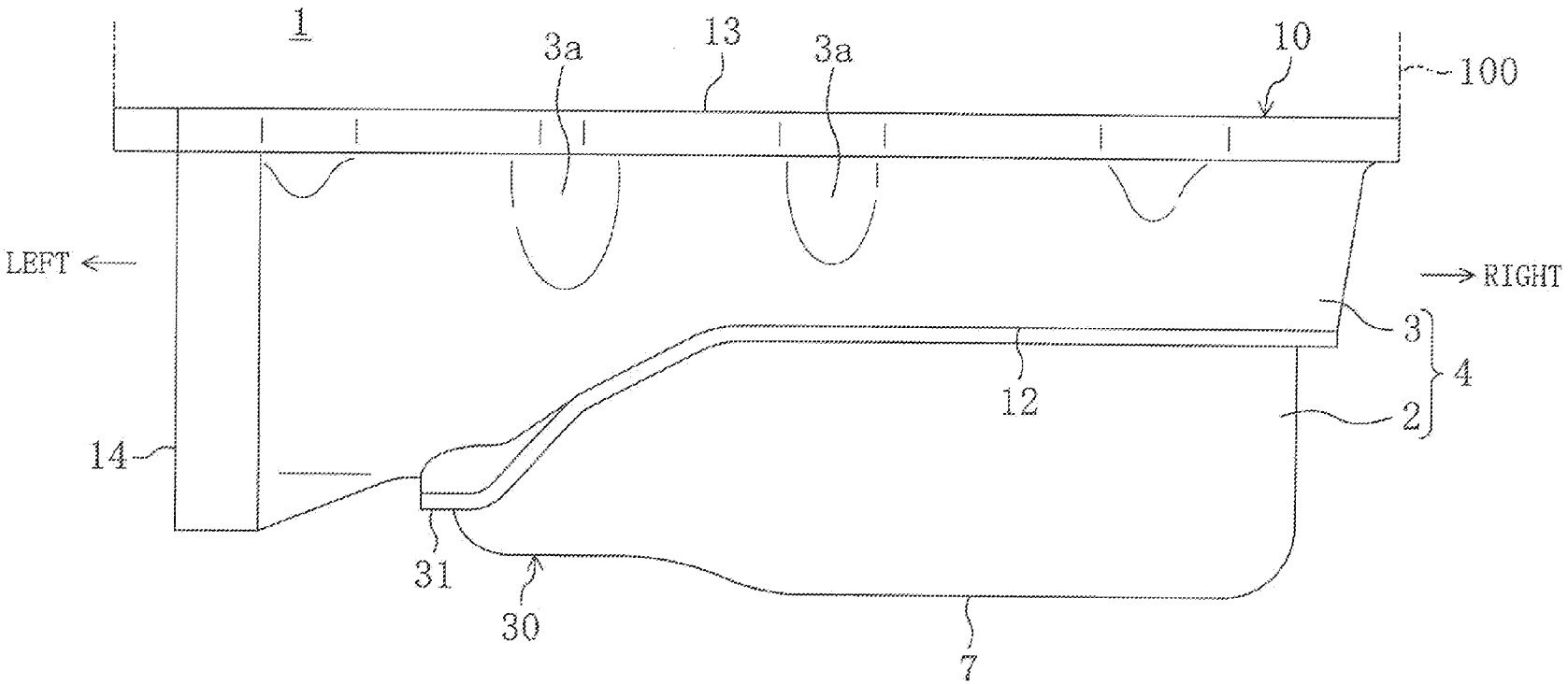
FIG. 2 is a view of the oil pan when viewed from the rear of a vehicle.
Figure 3:
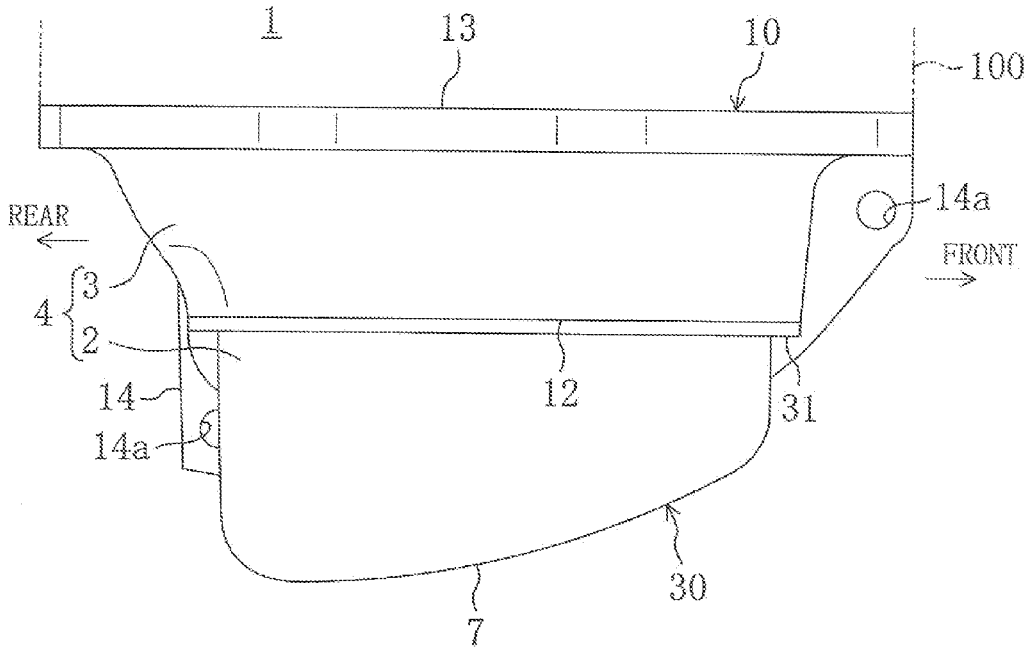
FIG. 3 is a right-side view of the oil pan.

FIG. 1 illustrates an oil pan 1 according to a first embodiment of the present invention. The oil pan 1 is intended to be used in an engine (not shown) mounted on an engine compartment at the front of an automobile, and is attached to the lower surface of a cylinder block 100 of the engine, as illustrated in FIGS. 2 and 3. The engine mounted in the engine compartment is positioned such that the crank shaft extends in the lateral direction of the automobile.

In the embodiments, the front side of the automobile is referred as the "front," the rear side of the automobile is referred to as the "rear," the left side of the automobile is referred as the "left," and the right side of the automobile is referred as the "right," for simplicity.

Figure 4:
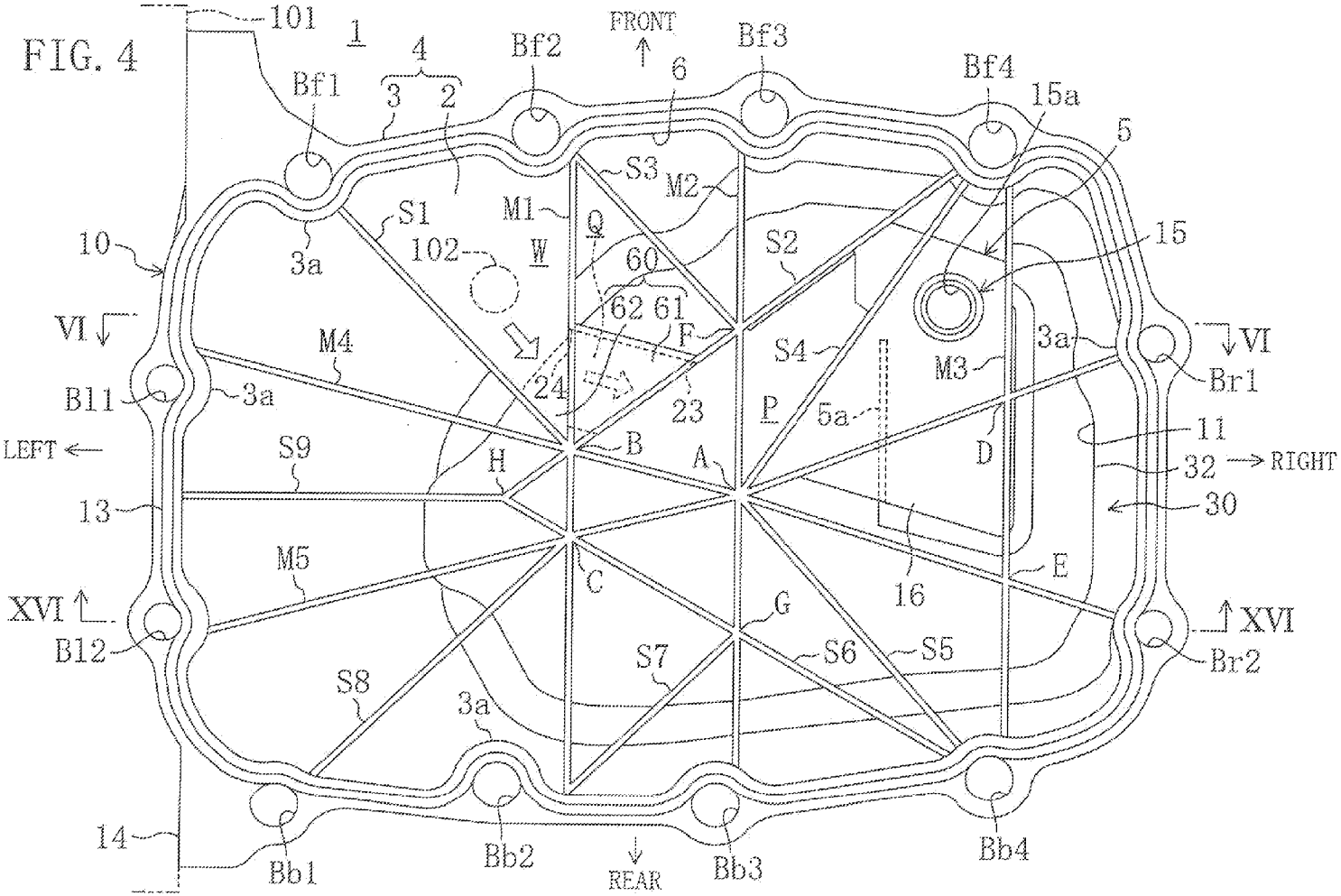
FIG. 4 is a plan view of the oil pan.
Figure 5:
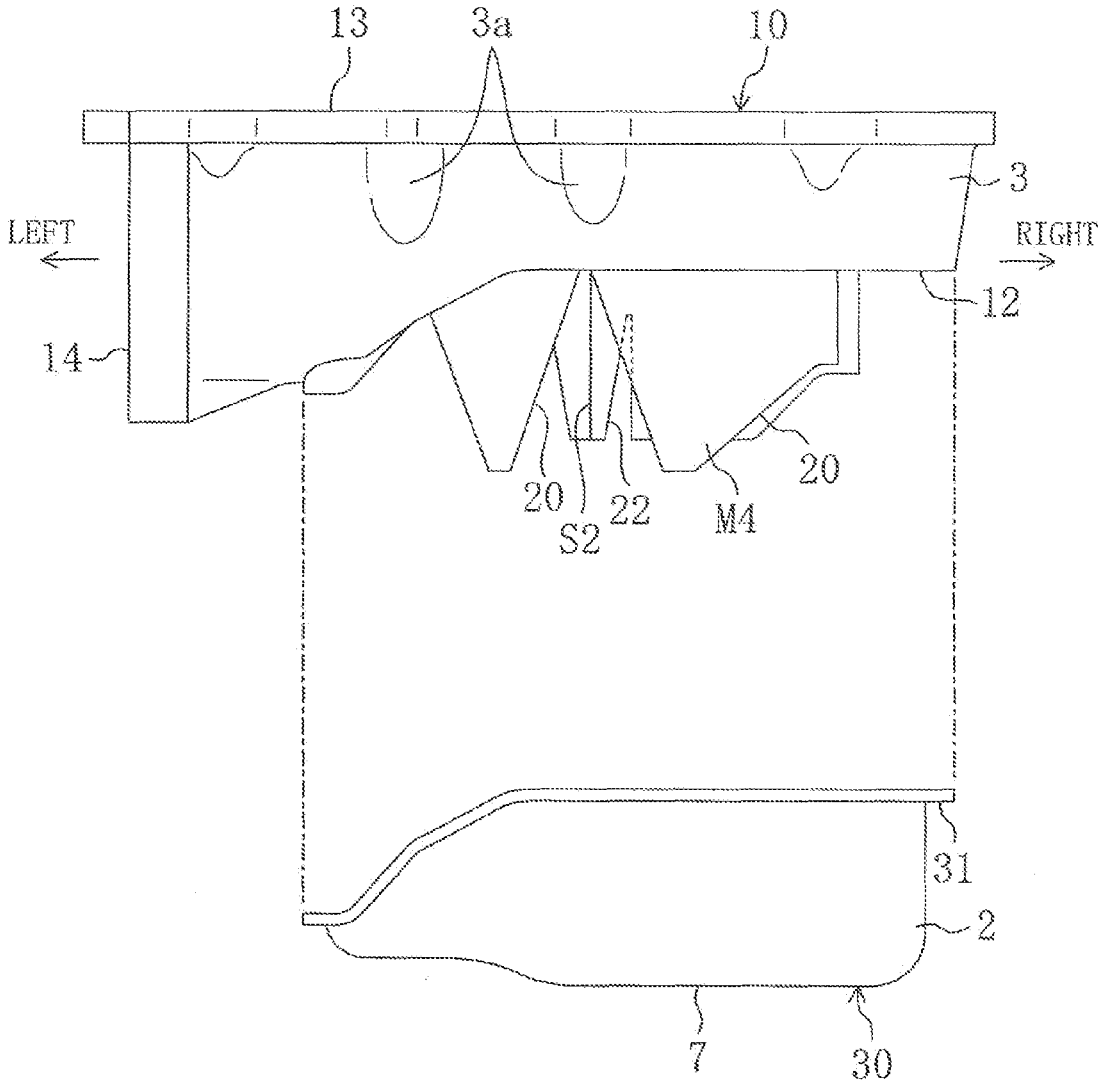
FIG. 5 is an exploded view of the oil pan.

The oil pan 1 includes: a recessed oil reservoir 4 formed by a bottom wall 2 covering substantially the entire bottom surface of the cylinder block 100 and a peripheral wall 3 rising from the periphery of the bottom wall 2; first through fifth main ribs M1-M5 and first through ninth auxiliary ribs S1-S9 provided in the oil reservoir 4 as illustrated in FIGS. 1 and 4; and an oil strainer 5 provided in the oil reservoir 4 in the same manner. As illustrated in FIG. 5, the oil pan 1 is formed by a combination of three members: an upper section (a first part) 10; a lower section (a second part) 30; and a filter element 50 (shown in FIG. 6). The upper and lower sections 10 and 30 are vertically disposed. As illustrated in FIG. 1, an opening 6 is formed at the top of the oil reservoir 4. Oil dropped from the cylinder block 100 flows into the oil reservoir 4 through this opening 6. The internal space of the oil reservoir 4 is divided into a main chamber P and a sub-chamber Z as described below (see, FIG. 4).

Figure 6:
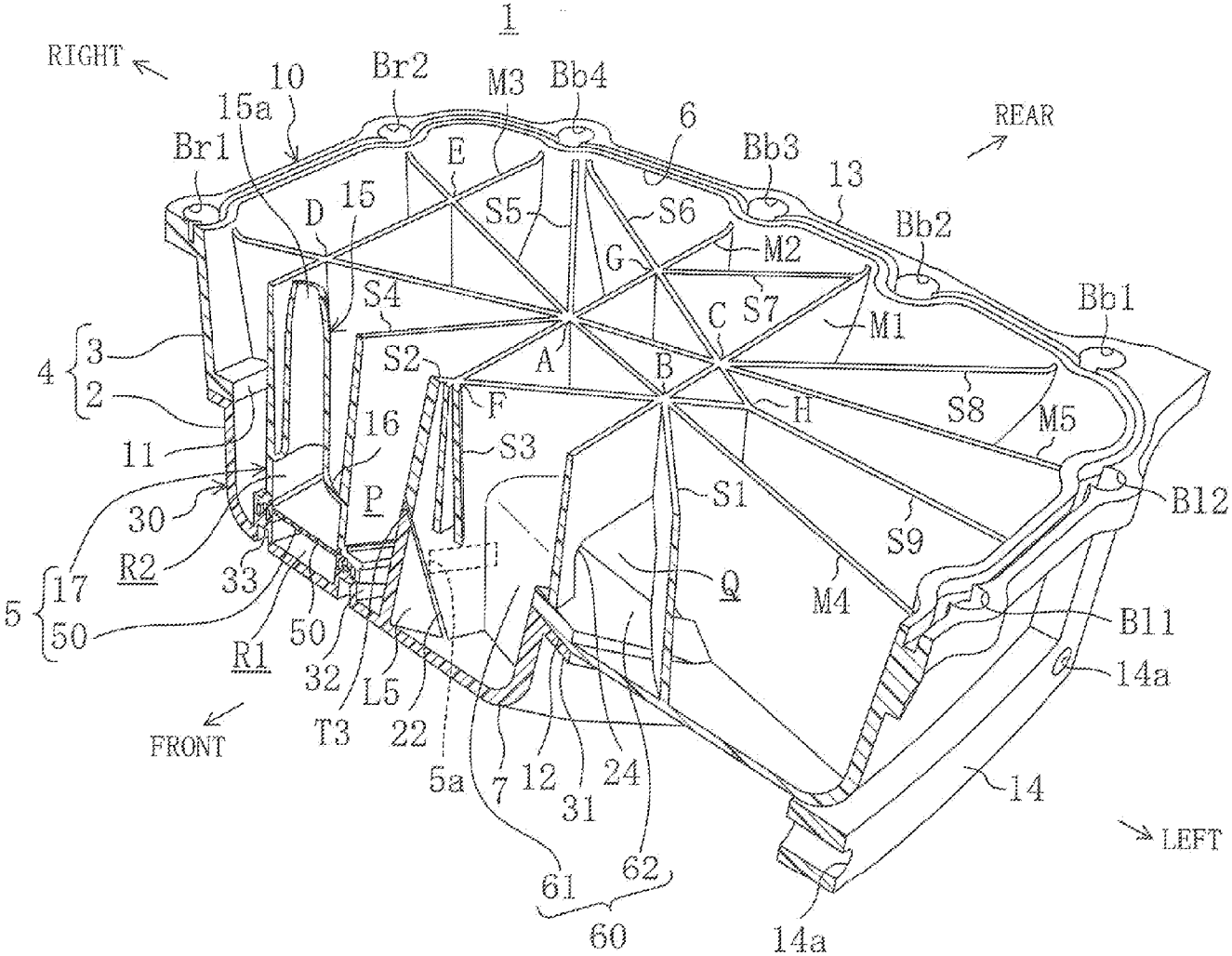
FIG. 6 is a perspective view illustrating a cross-sectional structure taken along line VI-VI in FIG. 4.

Oil in the oil reservoir 4 is filtered when passing through the oil strainer 5, and is sucked into an oil pump (not shown) of the engine, and fed to each part of the engine to circulate therein. Then, the oil returns to the oil reservoir 4, and passes through the oil strainer 5 again. As illustrated in FIG. 6, the oil strainer 5 includes the filter element 50, and a filter-element housing 17 for housing the filter element 50.

Figure 7:
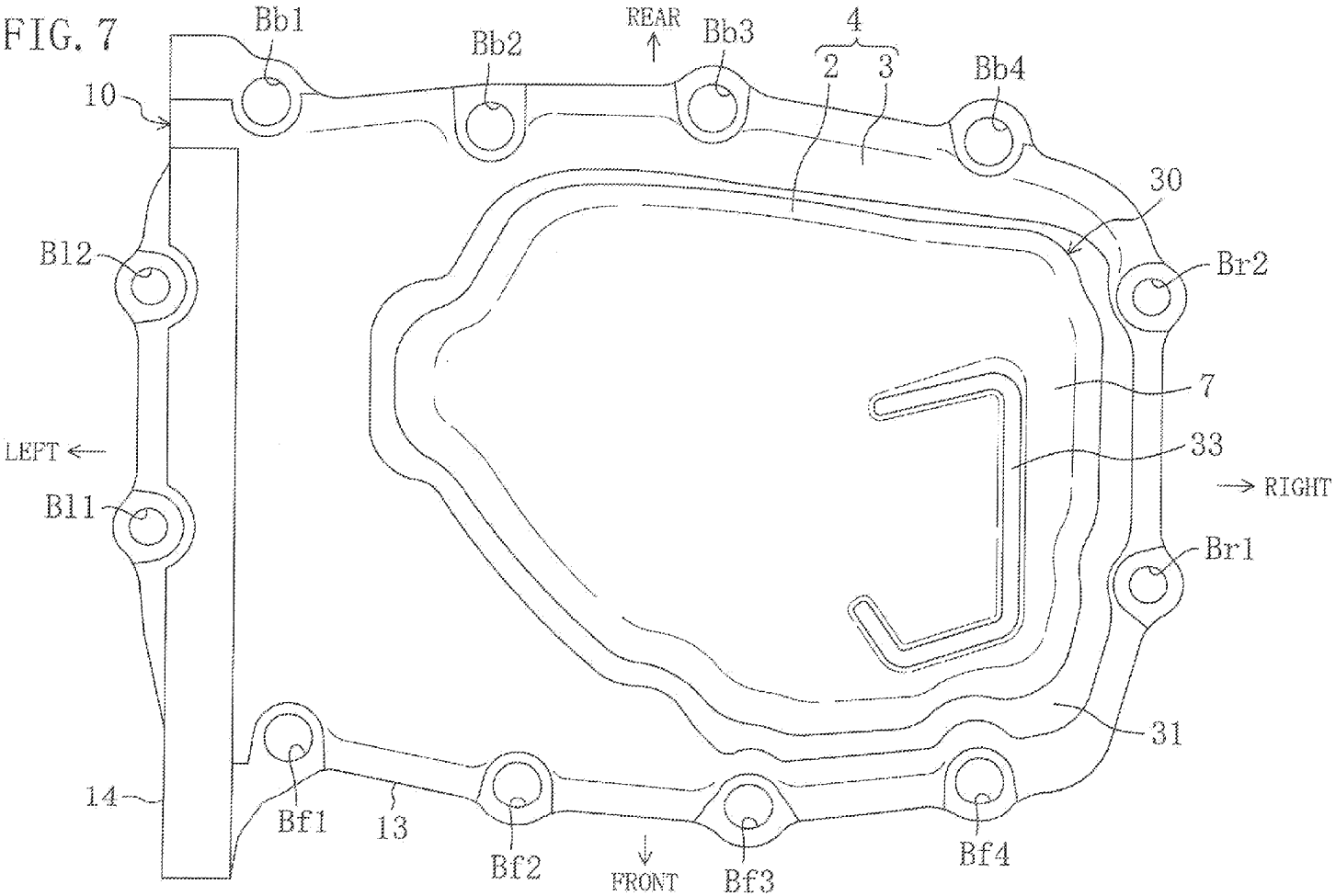
FIG. 7 is a bottom view of the oil pan.

As illustrated in FIGS. 2 and 3, the bottom wall 2 of the oil reservoir 4 is long in the lateral direction of the automobile. The bottom wall 2 has a downward protuberance 7. As illustrated in FIG. 7, the protuberance 7 extends from the right end of the bottom wall 2 across the middle of the bottom wall 2 in the lateral direction. As also illustrated in FIG. 2, the left end of the protuberance 7 is located at the right of the left end of the bottom wall 2. As illustrated in FIG. 7, the left end of the protuberance 7 projects toward the left at the middle thereof in the front-to-rear direction.

Figure 8:
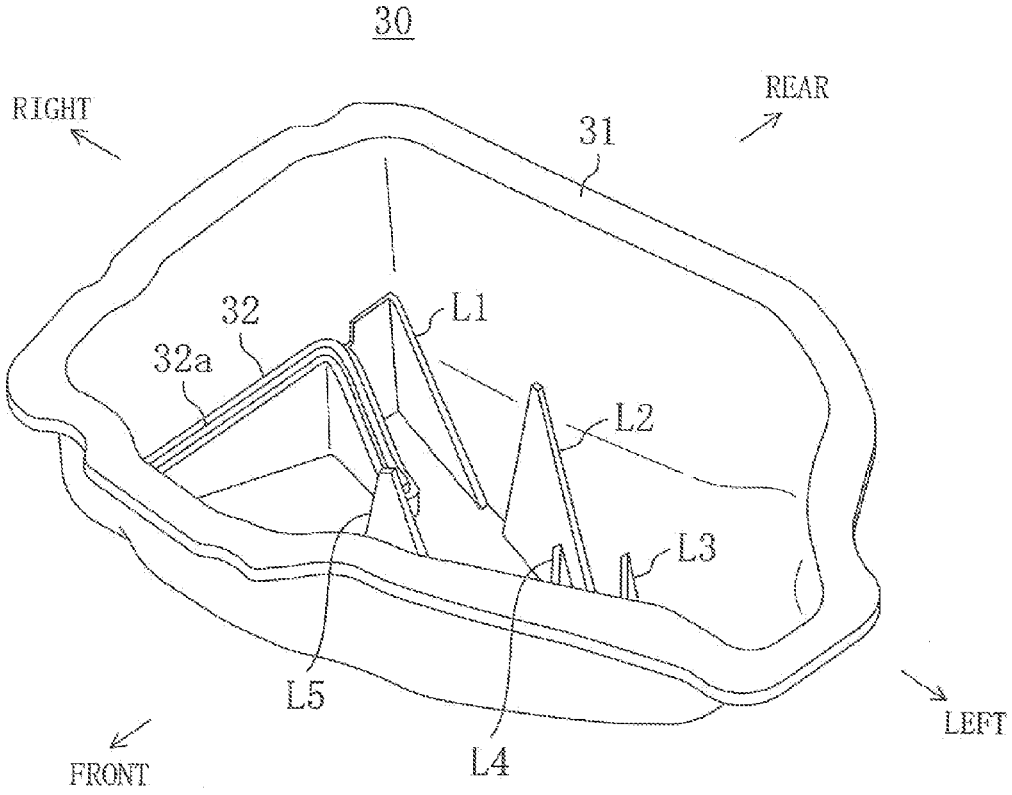
FIG. 8 is a perspective view of a lower section.
Figure 9:
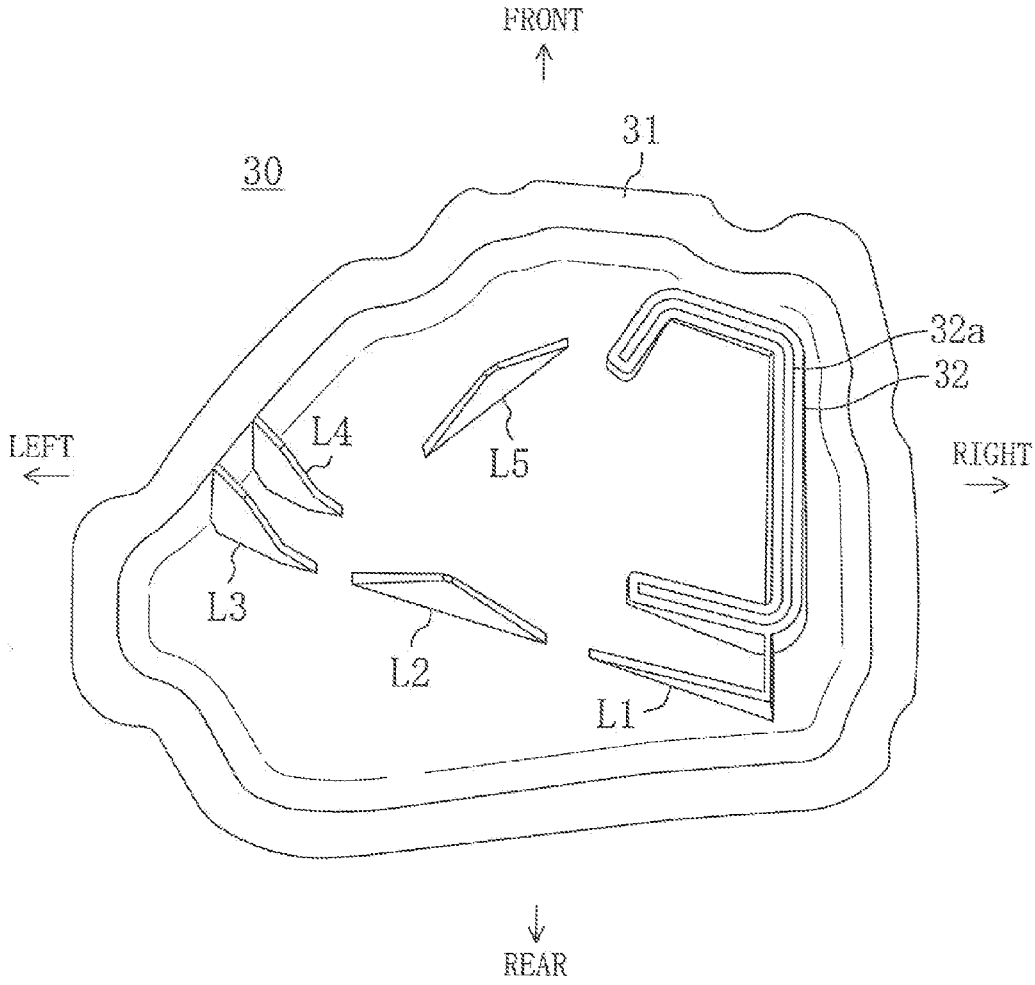
FIG. 9 is a plan view of the lower section.

As illustrated in FIG. 5, the protuberance 7 is included in the lower section 30. The part of the bottom wall 2 except for the protuberance 7 and the peripheral wall 3 are included in the upper section 10. The lower section 30 and the upper section 10 are made of resin. As illustrated in FIGS. 8 and 9, the lower section 30 is open at the top thereof. A lower joining portion 31 to be welded to the upper section 10 is formed at the top of the lower section 30. The lower joining portion 31 extends from the top of the lower section 30 to outside the protuberance 7, and is in the shape of an annular plate along the entire periphery of the top of the lower section 30.

Figure 10:
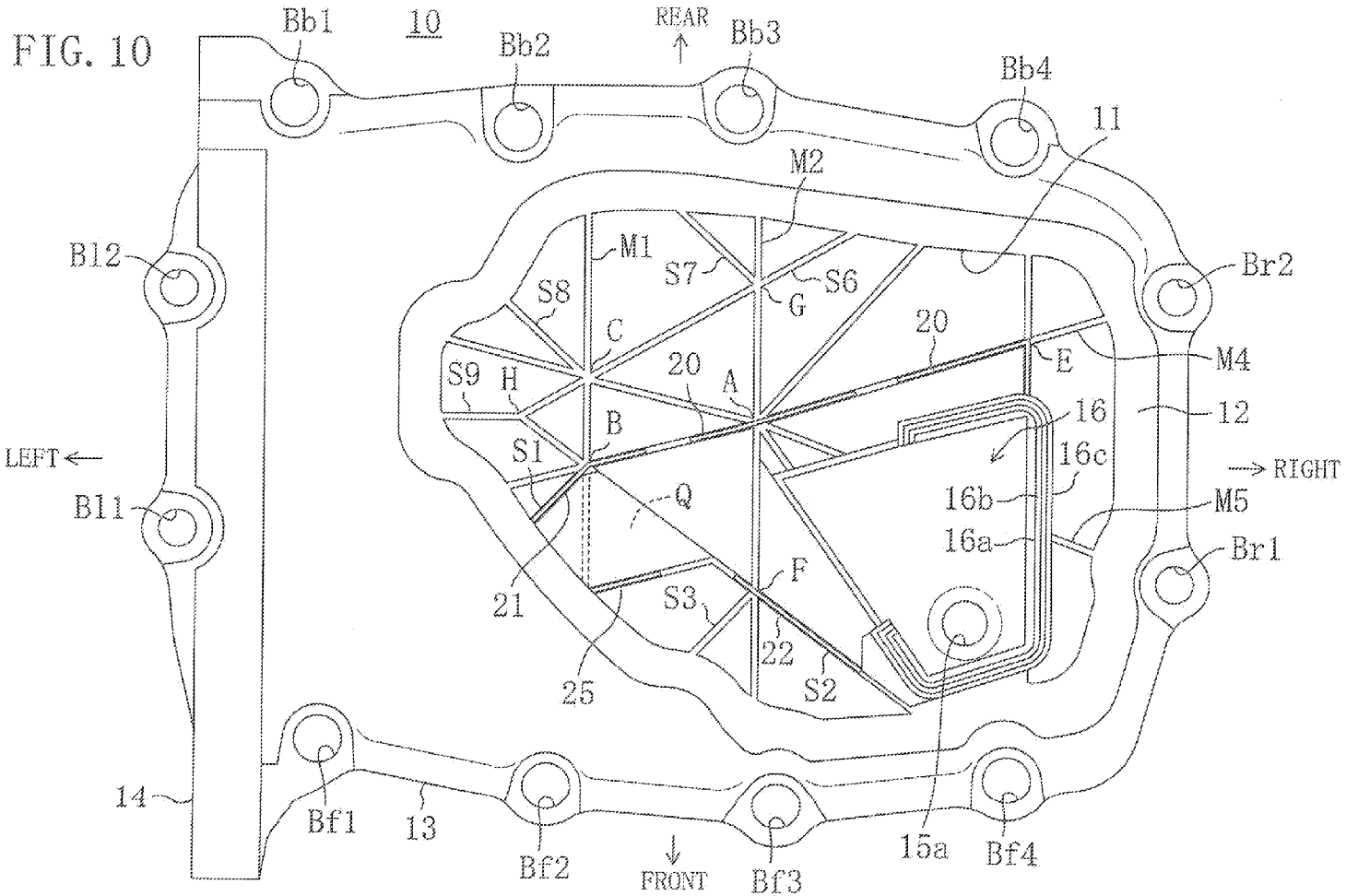
FIG. 10 is a bottom view of an upper section.

On the other hand, as illustrated in FIG. 10, a through hole 11 matching with the top of the lower section 30 is formed in the bottom of the upper section 10. An upper joining portion 12 to be welded to the lower joining portion 31 of the lower section 30 is formed around the through hole 11 of the upper section 10. The upper joining portion 12 is in the shape of a plate extending along the lower joining portion 31. The lower joining portion 31 and the upper joining portion 12 can be welded together by, for example, various welding techniques such as hot plate welding and vibration welding. Since the lower joining portion 31 at the top of the lower section 30 is in the shape of an annular plate along the entire periphery and extending outward from the lower section 30, and has its entire periphery joined to the upper joining portion 12, the rigidity of the oil pan 1 as a whole can be increased.

Figure 11:
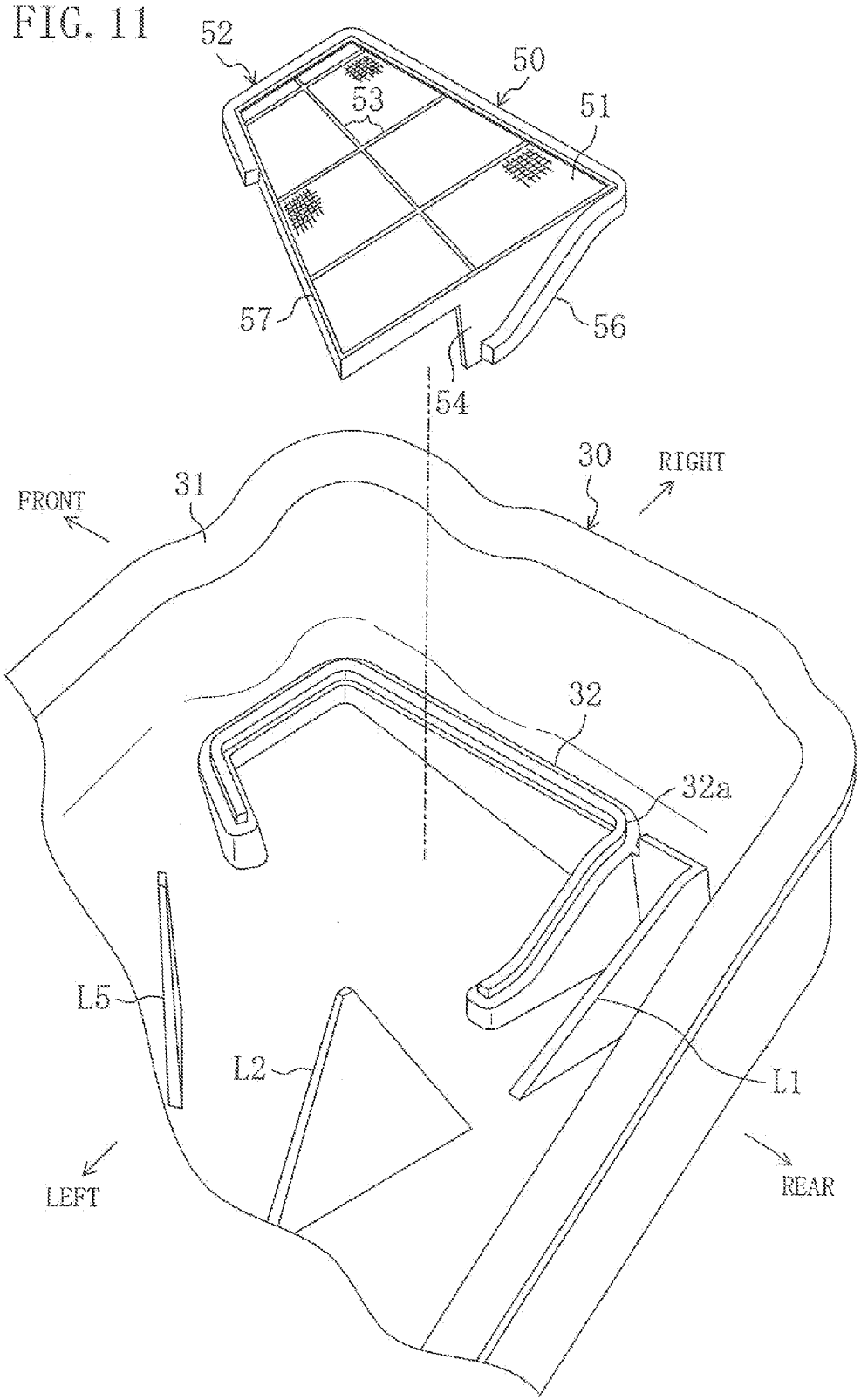
FIG. 11 is a perspective view illustrating a right portion of the lower section and a filter element.

As illustrated in FIG. 11, an element-fixing rib 32 to which the filter element 50 is fixed is formed on a right portion of the bottom wall of the lower section 30, and reinforces the bottom wall of the lower section 30. The element-fixing rib 32 is in the shape of a thick plate projecting upward from the bottom wall of the lower section 30. The element-fixing rib 32 extends to the right end at the front end of the bottom wall, then bends and extends rearward, and then bends to the left, thereby forming an approximate C-shape which is open at the left in plan view of FIG. 9. Since the element-fixing rib 32 bends in the manner described above, the rigidity of the rib 32 itself can also be increased.

Oil in the oil reservoir 4 flows into space formed by the element-fixing rib 32 through the opening at the left of the element-fixing rib 32. Reference numeral 33 in FIG. 7 denotes a groove formed by the element-fixing rib 32. In other words, the element-fixing rib 32 is a hollow rib.

Figure 12:
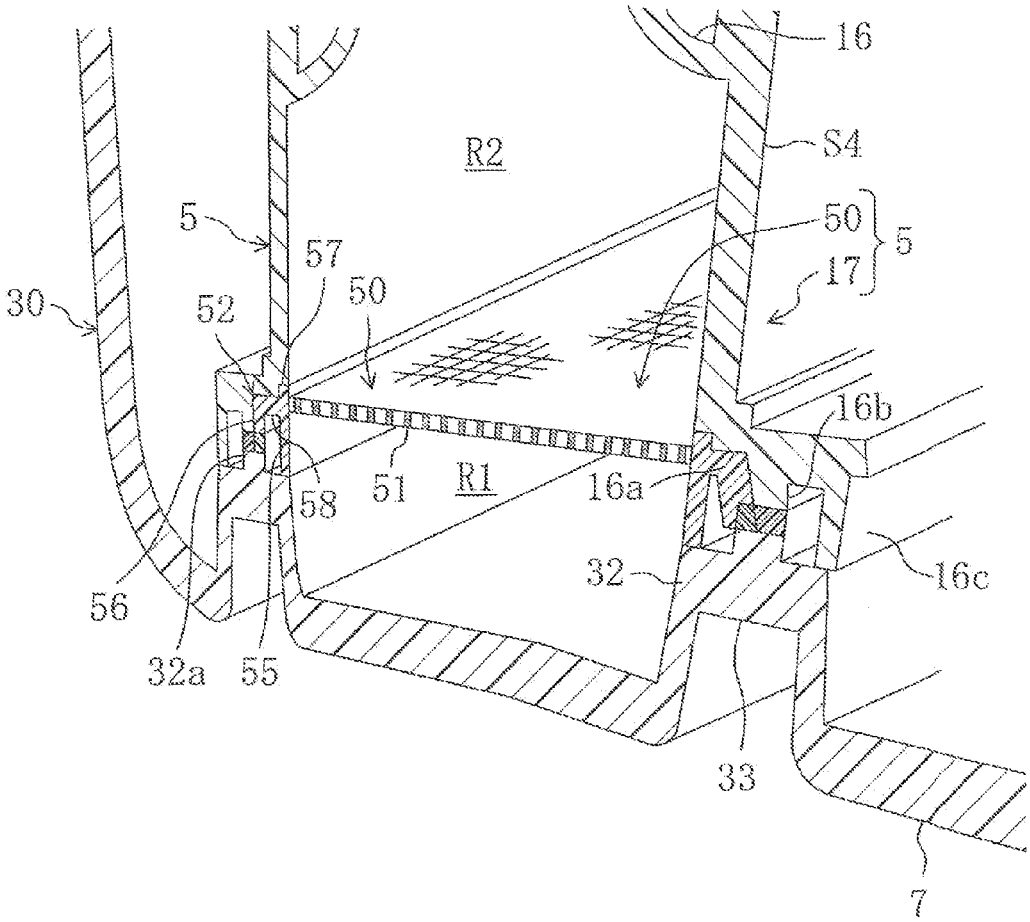
FIG. 12 is an enlarged view of a portion near an oil strainer and corresponding to FIG. 6.

As illustrated in FIG. 11, the height of the element-fixing rib 32 from the bottom wall increases toward the rear and toward the right end. An upward projection 32*a* is fowled at the top of the element-fixing rib 32. As illustrated in FIG. 12, this projection 32*a* is configured to be welded to the filter element 50 and the upper section 10.

As illustrated in FIGS. 8 and 9, first through fifth lower ribs L1-L5 projecting upward are formed on the bottom wall of the lower section 30. The first lower rib L1 is connected to a rear portion of the element-fixing rib 32, extends rearward, and then bends to the left. The height of a left portion of the first lower rib L1 gradually decreases toward the left end.

The second lower rib L2 is located at the left of the left side of the first lower rib L1, and is spaced apart from the first lower rib L1. The height of a right portion of the second lower rib L2 gradually decreases toward the right end, whereas the height of a left portion of the second lower rib L2 gradually decreases toward the left end. In other words, the second lower rib L2 is tapered.

The third lower rib L3 is located at the left of the left side of the second lower rib L2, is spaced apart from the second lower rib L2, and extends to the left front. The height of a right portion of the third lower rib L3 gradually decreases toward the right end. The left side of the third lower rib L3 is continuous to the inner surface of the lower section 30. The fourth lower rib L4 is located in front of the third lower rib L3, and is spaced apart from the third lower rib L3. The height of a right portion of the fourth lower rib L4 gradually decreases toward the right end. The left end of the fourth lower rib L4 is continuous to the inner surface of the lower section 30.

The fifth lower rib L5 is located in front of the second lower rib L2, is spaced apart from the second lower rib L2, and extends to the right front. The heights of left and right portions of the fifth lower rib L5 respectively decrease toward the both ends thereof, as the second lower rib L2, i.e., the fifth lower rib L5 is also tapered.

Figure 13:
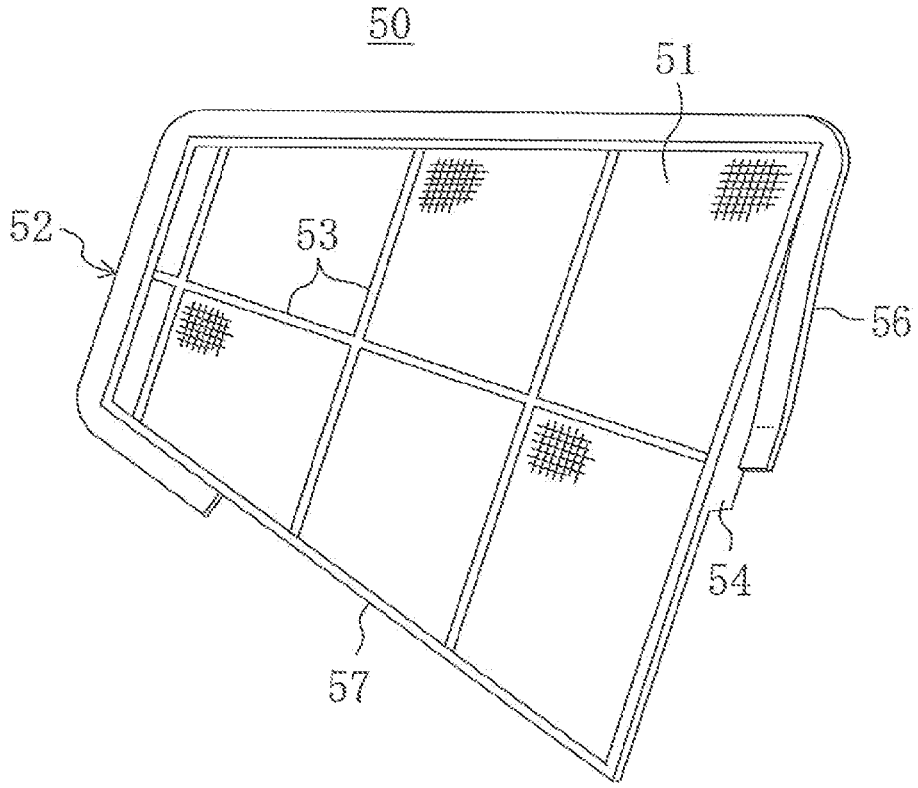
FIG. 13 is a plan view of the filter element.

As illustrated in FIG. 13, the filter element 50 is made of resin, and includes a plate-shape filter mesh 51 and an attaching portion 52 provided on the periphery of the mesh 51. As illustrated in FIG. 12, the filter element 50 is positioned such that the mesh 51 is substantially in parallel with the bottom wall of the lower section 30.

Figure 14:
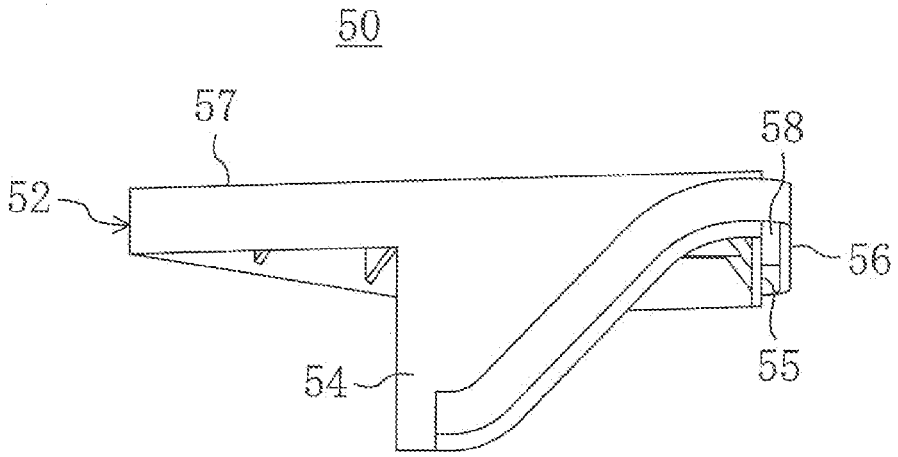
FIG. 14 is a view of the filter element when viewed from an engagement plate portion.

As also illustrated in FIG. 11, the mesh 51 is approximately rectangular to cover the top of the upper edge of the element-fixing rib 32. A plurality of reinforcement portions 53 extending in the length and width directions are provided on the mesh 51. As illustrated in FIG. 13, the attaching portion 52 has an approximately C-shape which matches with the shape of the top of the element-fixing rib 32 in plan view. As illustrated in FIGS. 11 and 14, the attaching portion 52 has an engagement plate portion 54 projecting downward to be engaged with a left rear portion of the element-fixing rib 32. In addition, as illustrated in FIG. 12, an inner projection 55 projecting downward and extending along the periphery is formed on the inner periphery of the attaching portion 52, and an outer projection 56 projecting downward in the same manner is formed on the outer periphery of the attaching portion 52. A groove 58 is formed between the inner projection 55 and the outer projection 56. An annular projection 57 extending along the entire periphery is formed on the periphery of the top of the mesh 51.

The tip (i.e., the lower end) of the inner projection 55 of the filter element 50 is located closer to the inside than the projection 32*a* at the top of the element-fixing rib 32 of the lower section 30. The tip (i.e., the lower end) of the outer projection 56 of the filter element 50 is welded to the projection 32*a* of the element-fixing rib 32 along the entire periphery. The space enclosed by the filter element 50 and the element-fixing rib 32 is an inflow room R1 into which oil flows in the oil strainer 5.

On the other hand, as illustrated in FIG. 1, an upper flange 13 extending outward from the oil reservoir 4 is formed on top of the peripheral wall 3 which is the top of the upper section 10. As also illustrated in FIG. 4, first through fourth front bolt-insertion holes (fastening portions) Bf1-Bf4 through which bolts (not shown) for fastening the oil pan 1 to the cylinder block 100 are inserted, are provided in a front portions of the upper flange 13, and are spaced apart from each other in the right-to-left direction. The first front bolt-insertion hole Bf1 is located near the left end of the upper flange 13, and the second through fourth front bolt-insertion holes Bf1-Bf4 are arranged in this order toward the right.

First through fourth rear bolt-insertion holes (fastening portions) Bb1-Bb4 are formed in a rear portion of the upper flange 13, and are spaced apart from each other in the right-to-left direction. The first through fourth rear bolt-insertion holes Bb1-Bb4 are arranged in the same manner as the first through fourth front bolt-insertion holes Bf1-Bf4.

First and second left bolt-insertion holes (fastening portions) Bl1 and Bl2 are provided in a left portion of the upper flange 13, and are spaced apart from each other in the front-to-rear direction. The first left bolt-insertion hole Bl1 is located toward the front side of the upper flange 13, and the second left bolt-insertion hole Bl2 is located toward the rear side of the upper flange 13.

First and second right bolt-insertion holes (fastening portions) Br1 and Br2 are formed in a right portion of the upper flange 13, and are spaced apart from each other in the same manner as the left bolt-insertion holes Bl1 and Bl2. Bolt-interference prevention portions 3*a*, 3*a*, . . . which are recessed toward the inside of the oil reservoir 4, are formed in portions of the peripheral wall 3 associated with the bolt insertion holes Bf1-Bf4, Bb1-Bb4, Bl1, Bl2, Br1, and Br2.

Side flanges 14 fastened to a casing 101 (indicated by virtual lines only in FIG. 4) of a transmission are formed in a left portion of the peripheral wall 3 at the left of the upper section 10. The side flanges 14 respectively project from the front and rear side of the peripheral wall 3. As illustrated in FIG. 1, three bolt-insertion holes 14*a*, 14*a*, and 14*a* through which bolts (not shown) are screwed into bolt holes formed in the casing 101 of the transmission, are formed in each of the side flanges 14, and are spaced apart from each other in the front-to-rear direction.

Figure 15:
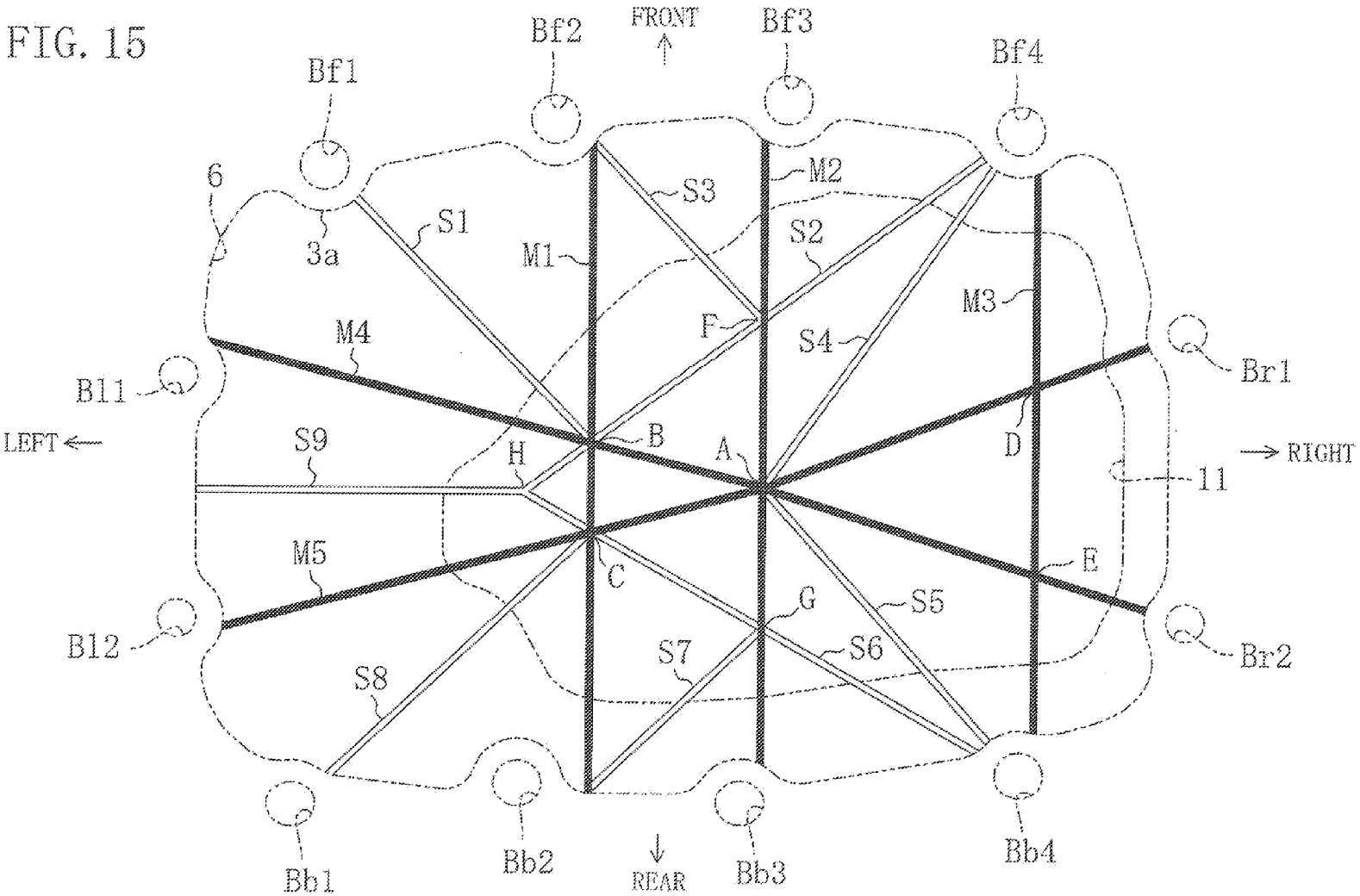
FIG. 15 is a plan view of main ribs and auxiliary ribs.

The first through fifth main ribs M1-M5 and the first through ninth auxiliary ribs S1-S9 are arranged in the upper section 10. In FIG. 15, the first through fifth main ribs M1-M5 are indicated by solid lines, and the first through ninth auxiliary ribs S1-S9 are indicated by hollow lines.

As illustrated in FIG. 15, the first main rib M1 extends straight from a portion near the second front bolt-insertion hole Bf2 to a portion near the second rear bolt-insertion hole Bb2 to join the fastening portions Bf2 and Bb2 to each other, and is located closer to the center of the through hole 11 than the left end of the through hole 11 of the upper section 10. The second main rib M2 extends straight from a portion near the third front bolt-insertion hole Bf3 to a portion near the third rear bolt-insertion hole Bb3.

The third main rib M3 extends straight from a portion near the fourth front bolt-insertion hole Bf4 to a portion near the fourth rear bolt-insertion hole Bb4. The first through third main ribs M1-M3 are substantially in parallel with each other.

Figure 16:
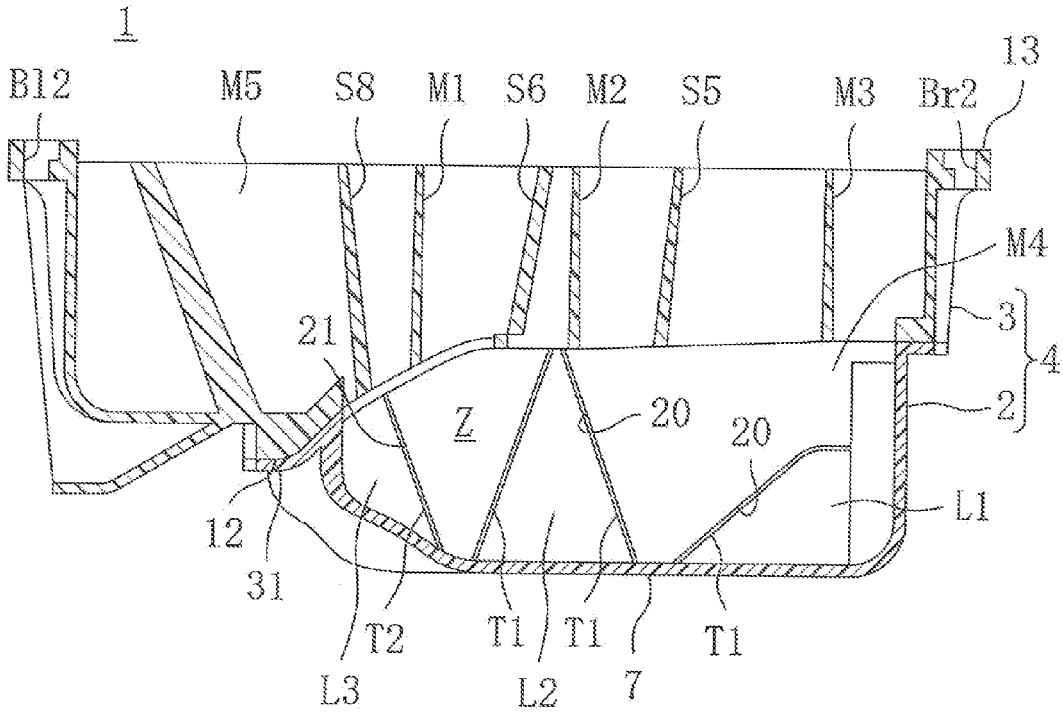
FIG. 16 is a cross-sectional view taken along line XVI-XVI in FIG. 4.

The fourth main rib M4 extends straight from a portion near the first left bolt-insertion hole Bl1 to a portion near the second right bolt-insertion hole Br2. As illustrated in FIG. 5, a lower portion of the fourth main rib M4 extends toward the bottom wall of the lower section 30. The fourth main rib M4 extends in a direction along which the first and second lower ribs L1 and L2 (shown in FIG. 9) of the lower section 30 extend, and is located directly above the first and second lower ribs L1 and L2. Specifically, the lower portion of the fourth main rib M4 has V-shaped notches 20 and 20 (see, FIGS. 5 and 10) in which the first and second lower ribs L1 and L2 shown in FIG. 8 are located. As illustrated in FIG. 16, gaps T1 and T1 through which oil can be distributed are respectively formed between the notches 20 and 20 and the first and second lower ribs L1 and L2. The sizes of the gaps T1 preferably increase toward the tops of the first and second lower ribs L1 and L2 in order to cause warm oil in the oil pan 1 to flow into the main chamber P in the manner which will be described later. The sizes of the gaps T1 may increase toward the bottoms of the first and second lower ribs L1 and L2.

As illustrated in FIG. 15, the fifth main rib M5 extends substantially straight from a portion near the second left bolt-insertion hole Bl2 to a portion near the fist right bolt-insertion hole Br1.

The second main rib M2, the fourth main rib M4, and the fifth main rib M5 intersect at a point A. The point A is located at the middle of the second main rib M2 in the front-to-rear direction. The fourth main rib M4 and the second main rib M2 do not intersect at right angles, and the fifth main rib M5 and the second main rib M2 do not intersect at right angles, either. Further, the fourth main rib M4 and the fifth main rib M5 do not intersect at right angles. Alternatively, the second, fourth, and fifth main ribs M2, M4, and M5 may intersect each other at right angles.

The fourth main rib M4 intersects the first main rib M1 and the third main rib M3 at points B and E, respectively. The fifth main rib M5 intersects the first main rib M1 and the third main rib M3 at points C and D, respectively. The points B-E are located within the through hole 11 of the upper section 10 in plan view. The bottoms of the first main rib M1, the fourth main rib M4, and the fifth main rib M5 are continuous to portions of the upper section 10 constituting the bottom wall 2. The ribs M1, M4, and M5 join the peripheral wall 3 and the bottom wall 2 to each other. The first through fifth main ribs M1-M5 extend across the opening 6 to join separate portions of the peripheral wall 3 to each other.

The first auxiliary rib S1 extends straight from a portion near the first front bolt-insertion hole Bf1 to the point B. A lower portion of the first auxiliary rib S1 extends to the bottom wall of the lower section 30. The third lower rib L3 of the lower section 30 illustrated in FIG. 8 is located directly under the first auxiliary rib S1. A portion of the third lower rib L3 is located under the fourth main rib M4. A notch 21 (see, FIG. 10) in which the third lower rib L3 is located, is formed in lower portions of the first auxiliary rib S1 and the fourth main rib M4. As illustrated in FIG. 16, a gap T2 through which oil can be distributed is formed between the notch 21 and the third lower rib L3. The size of the gap T2 preferably increases toward the top of the third lower rib L3, as described above. Alternatively, the size of the gap T2 may increase toward the bottom of the third lower rib L3.

As illustrated in FIG. 15, the second auxiliary rib S2 extends straight from a portion near the fourth front bolt-insertion hole Bf4 to the point B, and intersects the second main rib M2 at its intermediate portion, which is a point F. A lower portion of the second auxiliary rib S2 extends to the bottom wall of the lower section 30. The second auxiliary rib 52 extends in a direction along which the fifth lower rib L5 of the lower section 30 shown in FIG. 9 extends, and is located immediately above the fifth lower rib L5. A V-shaped notch 22 (see, FIGS. 6 and 10) in which the fifth lower rib L5 shown in FIG. 9 is located, is formed in a lower portion of the second auxiliary rib S2. As illustrated in FIG. 6, a gap T3 through which oil can be distributed is formed between the notch 22 and the fifth lower rib L5. The size of the gap T3 preferably increases toward the top of the fifth lower rib L5, as described above. Alternatively, the size of the gap T3 may increase toward the bottom of the fifth lower rib L5.

As illustrated in FIG. 15, the third auxiliary rib S3 extends straight from a portion near the second front bolt-insertion hole Bf2 to the point F. The fourth auxiliary rib S4 extends straight from a portion near the fourth front bolt-insertion hole Bf4 to the point A. The fifth auxiliary rib S5 extends straight from a portion near the fourth rear bolt-insertion hole Bb4 to the point A. The sixth auxiliary rib S6 extends straight from a portion near the fourth rear bolt-insertion hole Bb4 to the point C. The sixth auxiliary rib S6 intersects the second main rib M2 at its intermediate portion, which is a point G. The seventh auxiliary rib S7 extends from a portion near the second rear bolt-insertion hole Bb1 to the point G. The eighth auxiliary rib S8 extends straight from a portion near the first rear bolt-insertion hole Bb1 to the point C. The ninth auxiliary rib S9 extends to the right from a portion between the first and second left bolt-insertion holes Bl1 and Bl2, and then is divided into two portions which respectively extend to the point B and the point C. The point at which the ninth auxiliary rib S9 is divided is a point H. The bottoms of the first auxiliary rib S1, the third auxiliary rib S3, the sixth auxiliary rib S6, the seventh auxiliary rib S7, the eighth auxiliary rib S8, and the ninth auxiliary rib S9 are continuous to portions of the upper section 10 constituting the bottom wall 2. The first through fifth main ribs M1-M5 and the first through ninth auxiliary ribs S1-S9 are upright ribs extending substantially vertically, and are formed as one piece.

The first through fifth main ribs M1-M5 and the first through ninth auxiliary ribs S1-S9 extending as described above intersect each other to form triangles in plan view. For example, the first main rib M1, the sixth auxiliary rib S6, and the seventh auxiliary rib S7 form a triangle. The first left bolt-insertion hole Bl1, the second left bolt-insertion hole Bl2, and the point A also form a triangle. In this manner, intersections between the fastening portions and the ribs form triangles, thereby achieving a strong structure against external forces.

As illustrated in FIG. 4, return space W is defined, and sandwiched, by the first main rib M1 and the first auxiliary rib S1. A return pipe 102 (indicated by virtual lines in FIGS. 1 and 4) to which return oil from the cylinder block 100 is discharged, is located between the first main rib M1 and the first auxiliary rib S1, i.e., in the return space W, in plan view. With this configuration, most part of circulated oil drops into the return space W. Oil also drops from portions of the bottom surface of the cylinder block 100 except for the return pipe 102.

As illustrated in FIG. 4, the upper section 10 is provided with a cover 16 covering the top of the filter element 50 fixed to the element-fixing rib 32. As illustrated in FIG. 12, the cover 16 and the element-fixing rib 32 constitute the filter-element housing 17 for housing the filter element 50.

As illustrated in FIG. 4, the cover 16 is constituted by portions of the third main rib M3, the fifth main rib M5, and the fourth auxiliary rib S4, and is located in space surrounded by the third main rib M3, the fourth main rib M4, and the fourth auxiliary rib S4. The cover 16 has a rectangle shape substantially the same as the shape of the filter element 50 in plan view, and as illustrated in FIG. 12, the periphery of the cover 16 is continuous to intermediate portions, in the vertical direction, of the side surfaces of the ribs M3 and S4. In addition, as illustrated in FIG. 4, the fifth main rib M5 is located at an approximate center of the cover 16.

A discharge pipe 15 for discharging oil which has passed through the filter element 50 is formed in a front portion of the cover 16 to project upward. The discharge pipe 15 is located in the space surrounded by the third main rib M3, the fifth main rib M5, and the fourth auxiliary rib S4. The opening at the upper end of the discharge pipe 15 serves as a discharge port 15*a* through which oil from the filter element 50 is discharged.

As illustrated in FIG. 12, an engagement recess 16*a* with which the outer periphery of the filter element 50 is engaged, is formed in the bottoms of the third main rib M3, the fifth main rib M5, and the fourth auxiliary rib S4 at a position associated with the outer periphery of the filter element 50 along the entire periphery. A projecting welding portion 16*b* to be welded to the projection 32*a* of the element-fixing rib 32 of the lower section 30 is formed along the entire periphery, and is located closer to the outer periphery than the engagement recess 16*a*. A contact portion 16*c* to be in contact with a portion closer to the outer periphery than the projection 32*a* at the top of the element-fixing rib 32 is formed along the entire periphery, and is located closer to the outer periphery than the welding portion 16*b*.

The space surrounded by the cover 16 and the filter element 50 serves as an outflow room R2 for oil in the oil strainer 5. The cover 16 can firmly join the third main rib M3, the fifth main rib M5, and the fourth auxiliary rib S4 together.

As illustrated in FIG. 1, the top of the discharge pipe 15 is located near the top of the upper section 10. The discharge port 15*a* of the discharge pipe 15 is connected to an oil suction hole (not shown) formed in the bottom surface of the cylinder block 100 with the oil pan 1 attached to the cylinder block 100. A suction hole 5*a* (indicated by broken lines in FIGS. 4 and 6) of the oil strainer 5 is constituted by an opening portion of the element-fixing rib 32.

The fourth main rib M4 and the second auxiliary rib 52 of the upper section 10 and the lower ribs L1-L5 of the lower section 30 divide the inside of the oil reservoir 4 into the main chamber P and the sub-chamber Z. The main chamber P is the space surrounded by the fourth main rib M4, the second auxiliary rib S2, and the lower ribs L1-L5. The suction hole 5*a* of the oil strainer 5 faces the inside of the main chamber P. The volume of the main chamber P is preferably smaller than that of the sub-chamber 4 but may be equal to that of the sub-chamber Z. Alternatively, the volume of the sub-chamber Z may be smaller than that of the main chamber P.

Figure 17:
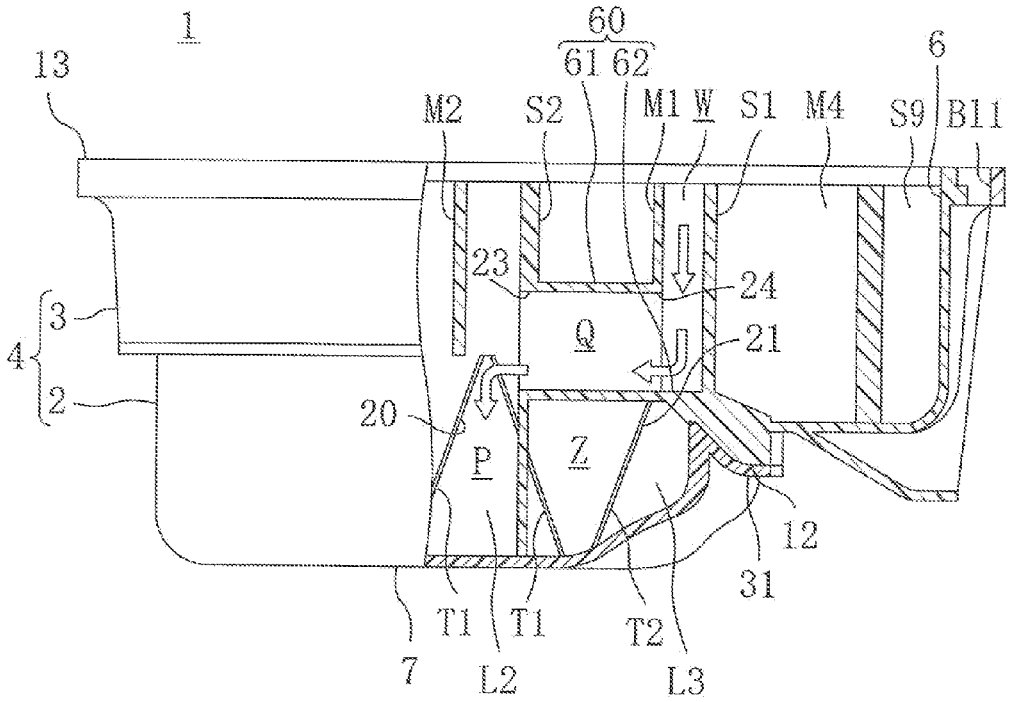
FIG. 17 is a cross-sectional view taken along line XVII-XVII in FIG. 4.

The first main rib M1, the first auxiliary rib S1, and the second auxiliary rib S2 of the upper section 10 has a guide part 60 for guiding return oil which has returned to the oil reservoir 4 through the return pipe 102 to the main chamber P. As also illustrated in FIG. 17, the guide part 60 includes: a tube portion 61 extending substantially in the right-to-left direction to join the first main rib M1 and the second auxiliary rib S2 to each other; and a guide plate portion 62 continuous to the bottom wall of the tube portion 61 and extending to the first auxiliary rib S1. The tube portion 61 is formed as one piece with the first main rib M1 and the second auxiliary rib S2. The guide plate portion 62 is formed as one piece with the first main rib M1 and the first auxiliary rib S1.

The tube portion 61 is configured to form a main oil passageway Q for allowing substantially the entire amount of return oil which has flown into the return space W to flow into the main chamber P. The left end of the tube portion 61 communicates with the return space W between the first main rib M1 and the first auxiliary rib S1, and the right end thereof communicates with the main chamber P. Specifically, an opening 24 facing the return space W is formed in an intermediate portion, in the vertical direction, of the first main rib M1. The left end of the tube portion 61 is connected to the opening 24. An opening 23 facing the main chamber P is formed in an intermediate portion, in the vertical direction, of the second auxiliary rib S2. The right end of the tube portion 61 is connected to the opening 23.

As also illustrated in FIG. 4, the guide plate portion 62 is used for guiding return oil to the main oil passageway Q of the tube portion 61 by closing the through hole 11 between the first main rib M1 and the first auxiliary rib S1, and thereby preventing the return oil from flowing downward through the through hole 11.

The guide part 60 described above enables oil circulated in the engine to be sucked directly into the oil strainer 5. The guide part 60 allows the first main rib M1, the first auxiliary rib S1, and the second auxiliary rib S2 to be joined together, thereby obtaining high rigidity.

A process of fabricating the oil pan 1 with the foregoing configuration will now be described. First, a resin material is injection molded to obtain an upper section 10, a lower section 30, and a filter element 50. Then, the filter element 50 is mounted on the upper section 10. Specifically, as illustrated in FIG. 12, an annular projection 57 of the filter element 50 is fitted into an engagement recess 16*a* of a cover 16. Thereafter, an outer projection 56 of the filter element 50 and a welding portion 16*b* of the cover 16 are brought into contact with a projection 32*a* of a filter-fixing rib 32.

Next, a lower joining portion 31 of the lower section 30 and an upper joining portion 12 of the upper section 10 are welded together by, for example, vibration welding. At this time, the outer projection 56 of the filter element 50 and the welding portion 16*b* of the cover 16 are welded to the projection 32*a* of the filter-fixing rib 32 at a time in the same manner. In this manner, a third main rib M3 and a fourth auxiliary rib S4 of the upper section 10 are joined to the element-fixing rib 32 of the lower section 30, thereby firmly joining the upper section 10 and the lower section 30 to each other.

To attach the thus-obtained oil pan 1 to a cylinder block 100, bolts are inserted into bolt-insertion holes Bf1-Bf4, Bb1-Bb4, Bl1, Bl2, Br1, and Br2, and are tightened. In this manner, an oil discharge pipe 15 of the oil pan 1 is connected to an oil suction hole of the cylinder block 100.

Then, when the engine starts to initiate operation of an oil pump, a negative pressure is created in the oil discharge pipe 15 to cause oil in a main chamber P to be sucked into an inflow room R1 through a suction hole 5*a* of an oil strainer 5. The oil in the inflow room R1 is filtered while passing through a mesh 51 of the filter element 50, and then flows into an outflow room R2. The oil in the outflow room R2 flows upward through the discharge pipe 15 to be supplied to each part of the engine.

A large part of oil circulated in parts of the engine, flows into return space W in an oil reservoir 4 of the oil pan 1 through a return pipe 102. This return oil is guided from the left end of a tube portion 61 to a main oil passageway Q by a guide plate portion 62 of a guide part 60, as indicated by white arrows in FIG. 17. Oil which has passed through the main oil passageway Q flows into a main chamber P from the right end of the tube portion 61. The return oil is warmer than other oil, and this relatively warm oil can be sucked into the oil strainer 5 from the main chamber P. Accordingly, the temperature of oil can be increased quickly, and thus a viscosity appropriate for lubricating each part of the engine can be obtained to reduce rotational resistance of the engine, resulting in enhancing fuel efficiency.

Return oil also flows into the main chamber P through the gaps T1 and T2 shown in FIG. 16 and the gap T3 shown in FIG. 6. However, because of high viscosity of oil in a cold state, the amounts of return oil flowing through the gaps T1, T2, and T3 are small. The amount of oil flowing through the gaps T1, T2, and T3 increases, as the oil viscosity decreases. The sizes of the gaps T1, T2, and T3 may differ from each other, or may be identical.

As illustrated in FIG. 15, all the points A through H as intersections of the first through fifth main ribs M1-M5 and the first through ninth auxiliary ribs S1-S9 are located within the through hole 11 of the upper section 10 in plan view. With this configuration, oil dropped in a portion between the fifth main rib M5 and the ninth auxiliary rib S9 and oil dropped in a portion between the fifth main rib M5 and the eighth auxiliary rib S8, for example, are caused to flow into the lower section 30 through the through hole 11, and are sucked into the oil strainer 5.

In addition, since the first through fifth main ribs M1-M5 join separate portions of the peripheral wall 3 of the oil reservoir 4 together, and extend across the opening 6 of the oil reservoir 4, the ribs M1-M5 can sufficiently increase rigidity of portions near the opening 6, which otherwise decreases easily. Further, the connection of the first through ninth auxiliary ribs S1-S9 to the first through fifth main ribs M1-M5 can provide higher rigidity. Accordingly, when an obstacle such as flying stones and curbs hits the oil pan 1 in driving of the automobile, deformation and damage of the oil pan 1 can be reduced. During rotation of the engine, vibration of the cylinder block 100 is transmitted to the oil pan 1. In this situation, the presence of the first through fifth main ribs M1-M5 and the first through ninth auxiliary ribs S1-S9 in the oil pan 1 can reduce vibration of the peripheral wall 3 and the bottom wall 2, thereby reducing noise. In addition, since the first through fifth main ribs M1-M5 and the first through ninth auxiliary ribs S1-S9 are joined to each other, vibration of these ribs M1-M5 and S1-S9 can be reduced.

Moreover, since the first through fifth main ribs M1-M5 and the first through ninth auxiliary ribs S1-S9 extend across the opening 6 of the oil reservoir 4, it is possible to arrange the first through fifth main ribs M1-M5 by effectively utilizing the space in the opening 6 while hardly changing the outer shape of the oil pan 1.

As described above, in the first embodiment, the ribs M1-M5 and S1-S9 in the oil reservoir 4 can increase rigidity of the oil pan 1. In addition, since the fourth main rib M4, the second auxiliary rib S2, and the first through fifth lower ribs L1-L5 divide the oil reservoir 4 into the main chamber P and the sub-chamber Z, it is unnecessary to provide an additional oil pan separator. Accordingly, the number of components of the engine can be reduced, thereby reducing cost.

In addition, the presence of the first through fifth main ribs M1-M5 and the auxiliary ribs S1-S9 in the oil reservoir 4 can increase rigidity of the oil pan 1. Further, since the guide part 60 for guiding oil which has returned to the oil reservoir 4 to the main chamber P is provided to be continuous to the ribs M1, S1, and S2, the guide part 60 can be provided in the oil pan 1 by utilizing the ribs M1, S1, and S2 without any additional structure for providing the guide part 60 in the oil pan 1. Accordingly, the configuration of the oil pan 1 including the guide part 60 can be simplified.

Moreover, since the first main rib M1, the first auxiliary rib S1, and the second auxiliary rib S2 can be joined together by the guide part 60, rigidity of the oil pan 1 can be further increased by utilizing the guide part 60.

Furthermore, since the oil pan 1 is divided into the upper section 10 and the lower section 30, the upper section 10 and the lower section 30 can be formed independently of each other. Accordingly, even if the shape of the oil pan 1 is complicated, the sections 10 and 30 can be easily feinted, and thus good formability can be obtained, as compared to a case where the sections 10 and 30 are formed as one piece. The upper section 10 is reinforced by the first through fifth main ribs M1-M5 and the first through ninth auxiliary ribs S1-S9, and has its rigidity increased. The third main rib M3 and the fourth auxiliary rib S4 of the upper section 10 having the thus-increased rigidity are joined to the element-fixing rib 32 of the lower section 30, thereby firmly uniting the upper section 10 and the lower section 30. At the same time, rigidity of the lower section 30 can be enhanced, resulting in that rigidity of the entire oil pan 1 made of resin to have light weight can be increased.

The element-fixing rib 32 provided in the lower section 30 can increase rigidity of the lower section 30. Coupling the element-fixing rib 32 and the lower section 30 can unite the upper section 10 and the lower section 30 more firmly.

In addition, the oil strainer 5 can be formed as one piece with the oil pan 1. The filter-element housing 17 of this oil strainer 5 is constituted by the third main rib M3, the fourth auxiliary rib S4, and the element-fixing rib 32. Accordingly, as compared to a case where the filter-element housing 17 is made of an additional member, the structure of the oil pan 1 can be simplified, and the weight of the oil pan 1 can be reduced.

Further, since the first through fifth main ribs M1-M5 extend across the opening 6 of the oil reservoir 4 to join separate portions of the peripheral wall 3 of the oil reservoir 4 together, the ribs M1-M5 can sufficiently increase rigidity of portions near the opening 6, which otherwise decreases easily, and vibration of parts of the oil pan 1 can be reduced, thereby reducing noise. Since the first through fifth ribs M1-M5 extend across the opening 6 of the oil reservoir 4 as described above, it is possible to arrange the first through fifth main ribs M1-M5 by effectively utilizing the space in the opening 6 while hardly changing the outer shape of the oil pan 1. Accordingly, it is possible to effectively arrange the first through fifth main ribs M1-M5 to obtain high rigidity, while achieving a compact size of the oil pan 1 including the first through fifth main ribs M1-M5.

Since the first through fifth main ribs M1-M5 extend from portions near the bolt-insertion holes Bf2-Bf4, Bb2-Bb4, Bl1, Bl2, Br1, and Br2, strength of portions around the bolt-insertion holes Bf2-Bf4, Bb2-Bb4, Bl1, Bl2, Br1, and Br2 can also be increased by utilizing the first through fifth main ribs M1-M5.

In addition, since portions near the bolt-insertion holes Bf2-Bf4, Bb2-Bb4, Bl1, Bl2, Br1, and Br2 are joined to each other by the first through fifth main ribs M1-M5, strength of portions near the bolt-insertion holes Bf2-Bf4, Bb2-Bb4, Bl1, Bl2, Br1, and Br2 can be further increased.

Further, since the second, fourth, and fifth main ribs M2, M4, and M5 joining portions near the bolt-insertion holes Bf3, Bb3, Bl1, Bl2, Br1, and Br2 intersect each other, a force applied to, for example, the second main rib M2 from the front to the rear is distributed to the fourth main rib M4 and the fifth main rib M5. Accordingly, deformation and damage of the oil pan 1 can be reduced.

Further, since the first through fifth main ribs M1-M5 and the first through ninth auxiliary ribs S1-S9 intersect each other to form triangles in plan view, the structure of the oil pan 1 is less likely to be deformed by a force applied to the side of the peripheral wall 3, thereby further increasing rigidity.

Furthermore, the first, fourth, and fifth main ribs M1, M4, and M5 are continuous to portions of the upper section 10 constituting the bottom wall 2, the bottom wall 2 and the peripheral wall 3 can be joined together by the ribs M1, M4, and M5, thereby further increasing rigidity of the oil reservoir 4.

Moreover, an oil pan 1 of an automobile can be hit by flying stones from the front during driving in some cases. In this embodiment, since the first through third main ribs M1-M3 extend in the front-to-rear direction, an impact of the flying stones is received by the first through third main ribs M1-M3, and thereby, deformation and damage can be reduced.

In addition, since the first, fourth, and fifth main ribs M1, M4, and M5, and the first, third, sixth, seventh, eighth, and ninth auxiliary ribs S1, S3, S6, S7, S8, and S9 are continuous to portions of the upper section 10 constituting the bottom wall 2, rigidity of the bottom wall 2 can be increased. Accordingly, even when a jack is fixed to the bottom wall 2 of the oil pan 1 to jack up an automobile, deformation and damage of the bottom wall 2 can be reduced.

In a case where a centrifugal force is produced during driving of the automobile, the first through fifth lower ribs L1-L5, the fourth main rib M4, and the second auxiliary rib S2, for example, can reduce nonuniform distribution of oil in the oil pan 1. Consequently, it is possible to reduce sucking of air into the oil pump.

The first through fifth main ribs M1-M5 and the first through ninth auxiliary ribs S1-S9 may have notches or through holes through which oil can be distributed.

In this embodiment, the oil pan 1 is formed by a combination of the upper section 10 and the lower section 30. Alternatively, the oil pan 1 may be formed as one piece.

The number of the first through fifth main ribs M1-M5 and the first through ninth auxiliary ribs S1-S9 is not limited to the above embodiment, and for example, no auxiliary ribs may be provided. The first through fifth main ribs M1-M5 may have the same thickness as that of the first through ninth auxiliary ribs S1-S9, but may have thicknesses different from those of the first through ninth auxiliary ribs S1-S9. The first through fifth main ribs M1-M5 and the first through ninth auxiliary ribs S1-S9 may be curved.

Any one of the first through fifth main ribs M1-M5 and the first through ninth auxiliary ribs S1-S9 may be formed to be continuous to the bottom wall 2. In this case, the rib continuous to the bottom wall 2 may be formed as one piece with the bottom wall 2, may be welded to the bottom wall 2, or may be bonded to the bottom wall 2 with an adhesive.

Any one of the first through fifth main ribs M1-M5 and the first through ninth auxiliary ribs S1-S9 may be bonded to the lower section 30 by welding or with an adhesive.

Any one of the first through fifth lower ribs L1-L5 may be bonded to the upper section 10 by welding or with an adhesive.

The first through fifth main ribs M1-M5 may be located at positions separated from the bolt-insertion holes Bf1-Bf4. Bb1-Bb4, Bl1, Bl2, Br1, and Br2.

In this embodiment, the oil strainer 5 is formed as one piece with the oil pan 1. Alternatively, the oil strainer 5 and the oil pan 1 may be formed as separate parts so that the oil strainer 5 is mounted to an engine independently of the oil pan 1. Alternatively, the oil strainer may be mounted to the oil pan 1.

The fourth main rib M4 of the upper section 10 and the first through third lower ribs L1-L3 of the lower section 30 may be welded or bonded together. These ribs may be welded or bonded to the second auxiliary rib 52 and the fifth lower rib L5, and may also be welded or bonded to the upper section 10 and the fourth lower rib L4 of the lower section 30.

Figure 18:
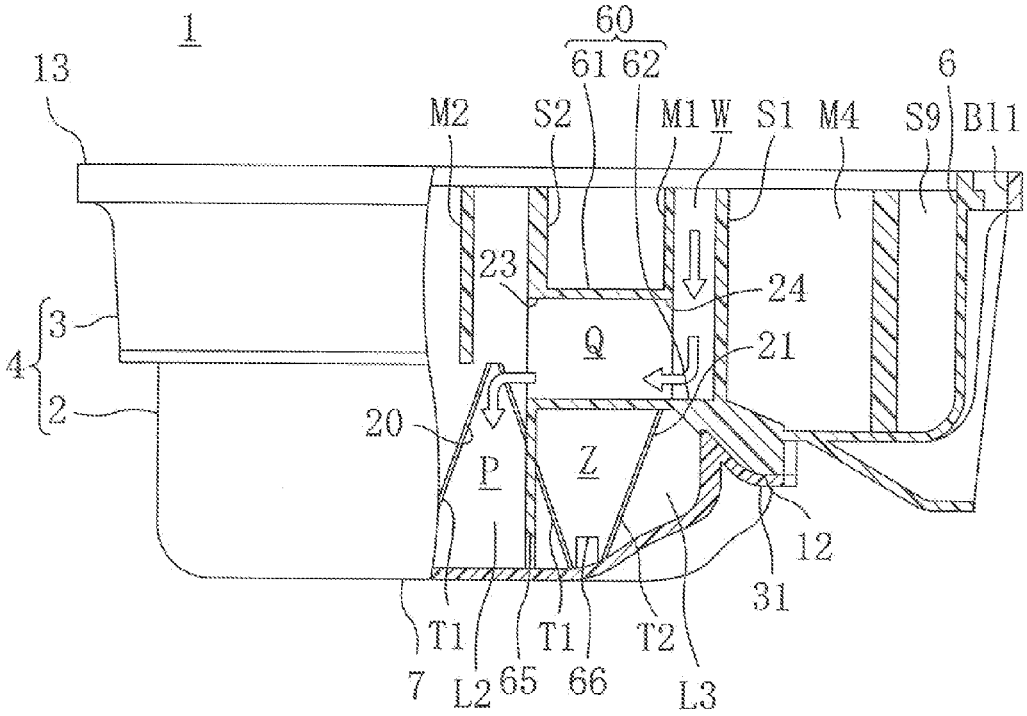
FIG. 18 is a view corresponding to FIG. 17 and illustrating a first modified example.

As a first modified example illustrated in FIG. 18, a through hole 65 for establishing communication between the main chamber P and the sub-chamber Z may be formed in the bottom of the second auxiliary rib S2. A through hole 66 for establishing communication between the main chamber P and the sub-chamber Z may be formed in the bottom of the fourth main rib M4. These through holes 65 and 66 may be formed in intermediate portions, in the vertical direction, of the ribs S2 and M4.

Figure 19:
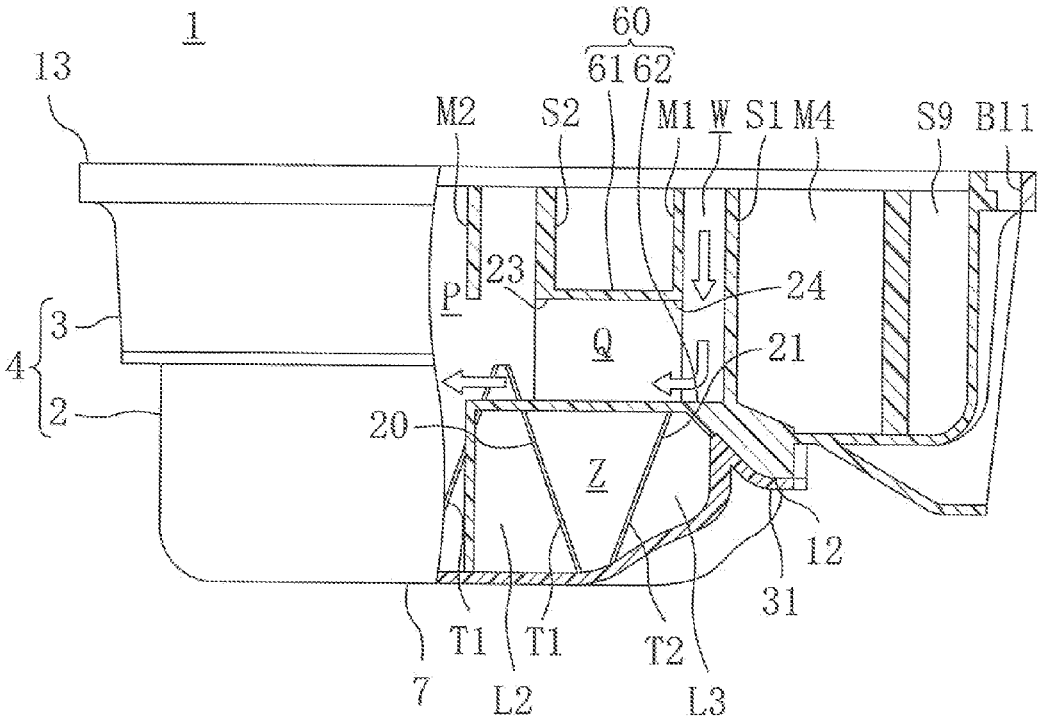
FIG. 19 is a view corresponding to FIG. 17 and illustrating a second modified example.

As a second modified example illustrated in FIG. 19, the bottom wall of the tube portion 61 of the guide part 60 may extend toward the oil strainer 5 so that return oil is caused to flow into a portion near the suction hole 5*a*. With this configuration, the temperature of oil to be sucked into the suction hole 5*a* after a cold start can be further increased.

Figure 20:
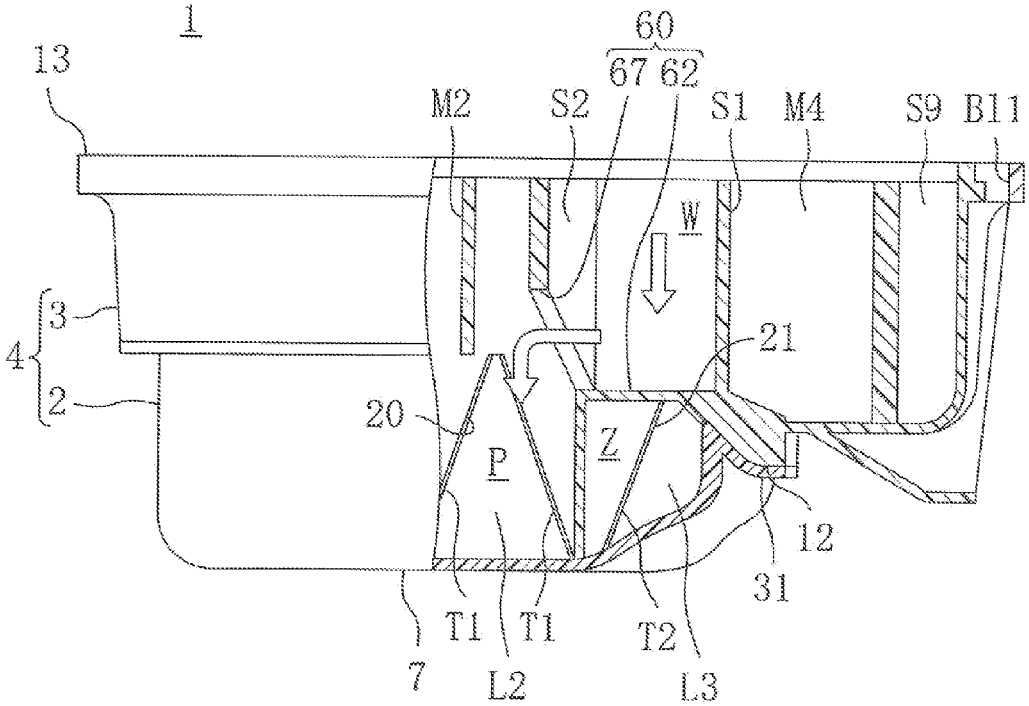
FIG. 20 is a view corresponding to FIG. 17 and illustrating a third modified example.

As a third modified example illustrated in FIG. 20, no tube portion 61 is provided, and a through hole 67 formed in the second auxiliary rib S2 and the guide plate portion 62 may constitute the guide part 60. The upper edge of this through hole 67 is located closer to the oil strainer 5 than the lower edge of the through hole 67.

Figure 21:
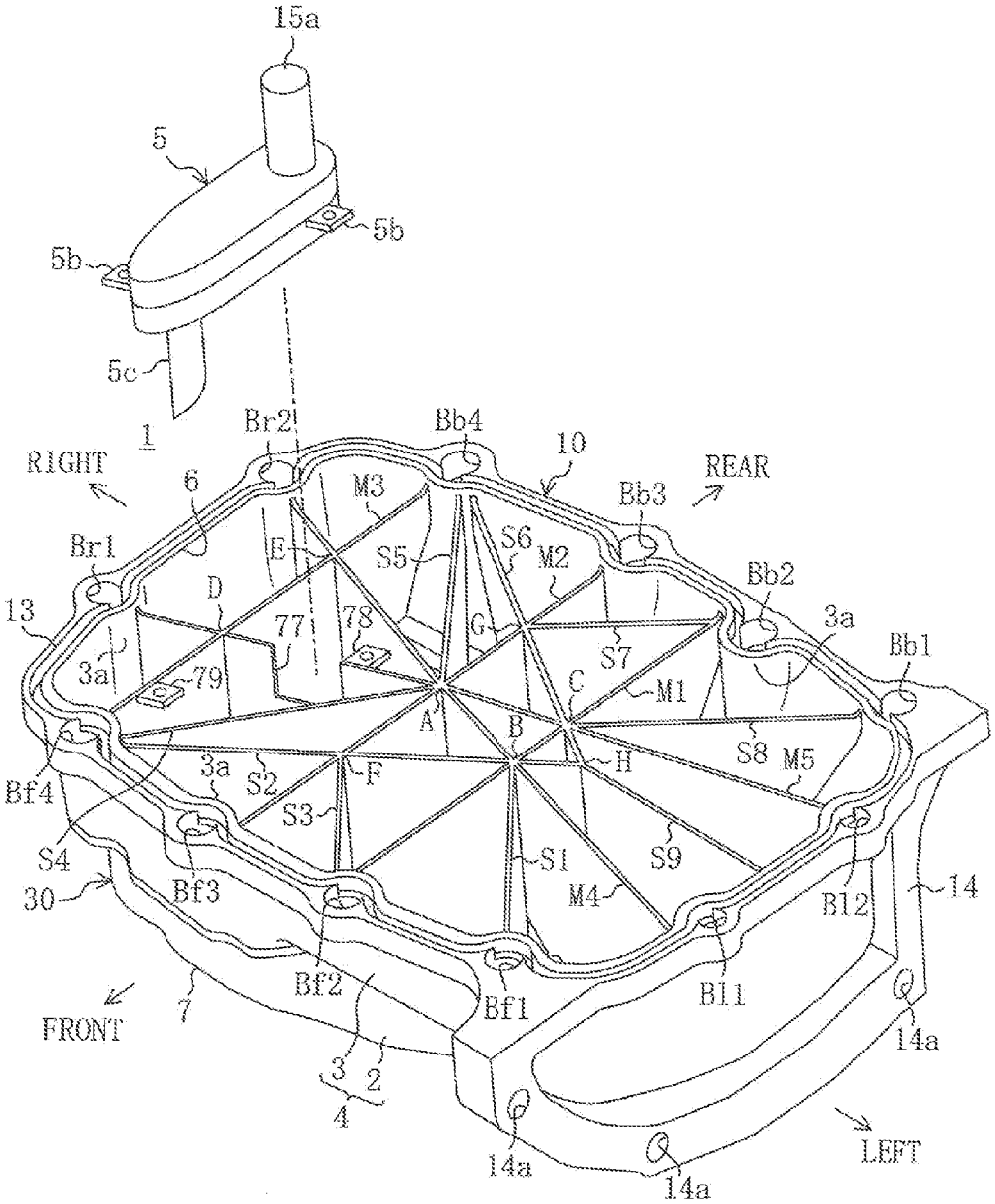
FIG. 21 is an exploded perspective view of an oil pan according to a fourth modified example.

As in a fourth modified example illustrated in FIG. 21, the oil strainer 5 and the oil reservoir 4 may be formed as separate parts so that the oil strainer 5 is disposed in the main chamber P. A discharge port 15*a* is formed in an upper portion of the oil strainer 5, and a suction pipe 5*c* is formed in a lower portion of the oil strainer 5. A suction port (not shown) is formed at the bottom of the suction pipe 5*c*. Attachment flanges (fixing portions) 5*b* and 5*b* having fastening holes are formed at the periphery of the oil strainer 5.

On the other hand, the fifth main rib M5 of the oil reservoir 4 of the fourth modified example has a notch 77 having a shape associated with the shape of the oil strainer 5. The fifth main rib M5 has a fastening plate portion 78 to which one of the attachment flanges 5*b* is engaged and fixed. The third main rib M3 has a fastening plate portion 79 to which the other attachment flange 5*b* is engaged and fixed. The oil strainer 5 is attached to the oil reservoir 4 by fixing the attachment flanges 5*b* and 5*b* to the fastening plate portions 78 and 79 with a fastening material (not shown). The oil strainer 5 may be attached to the oil reservoir 4 by welding or with an adhesive, for example, without using a fastening material.

Embodiment 2

Figure 22:
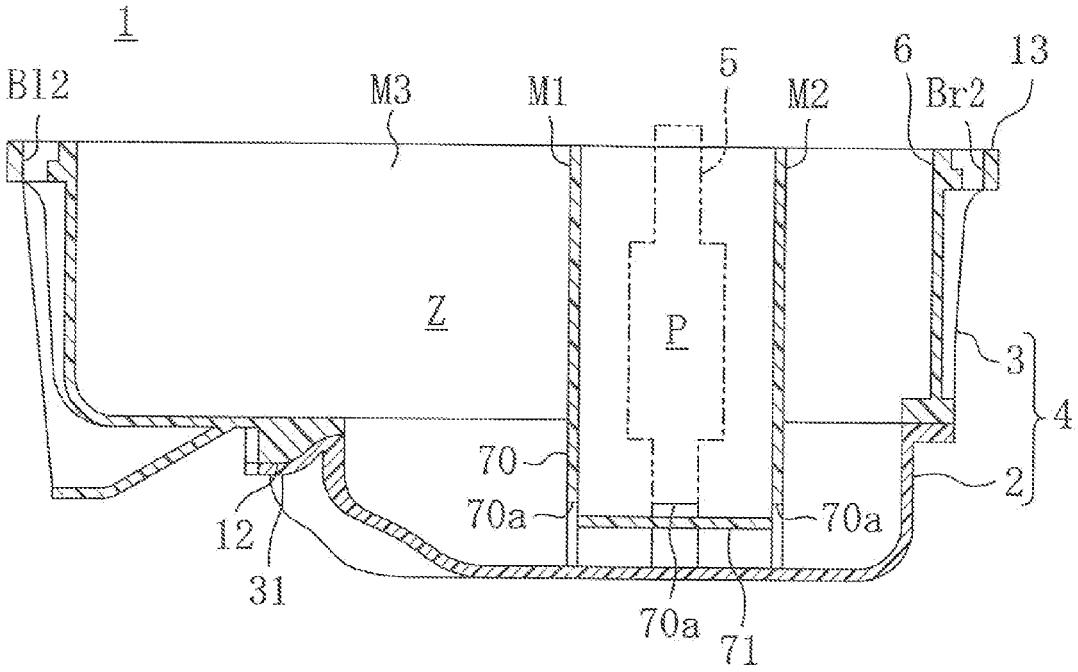
FIG. 22 is a view corresponding to FIG. 16 and illustrating a second embodiment.
Figure 23:
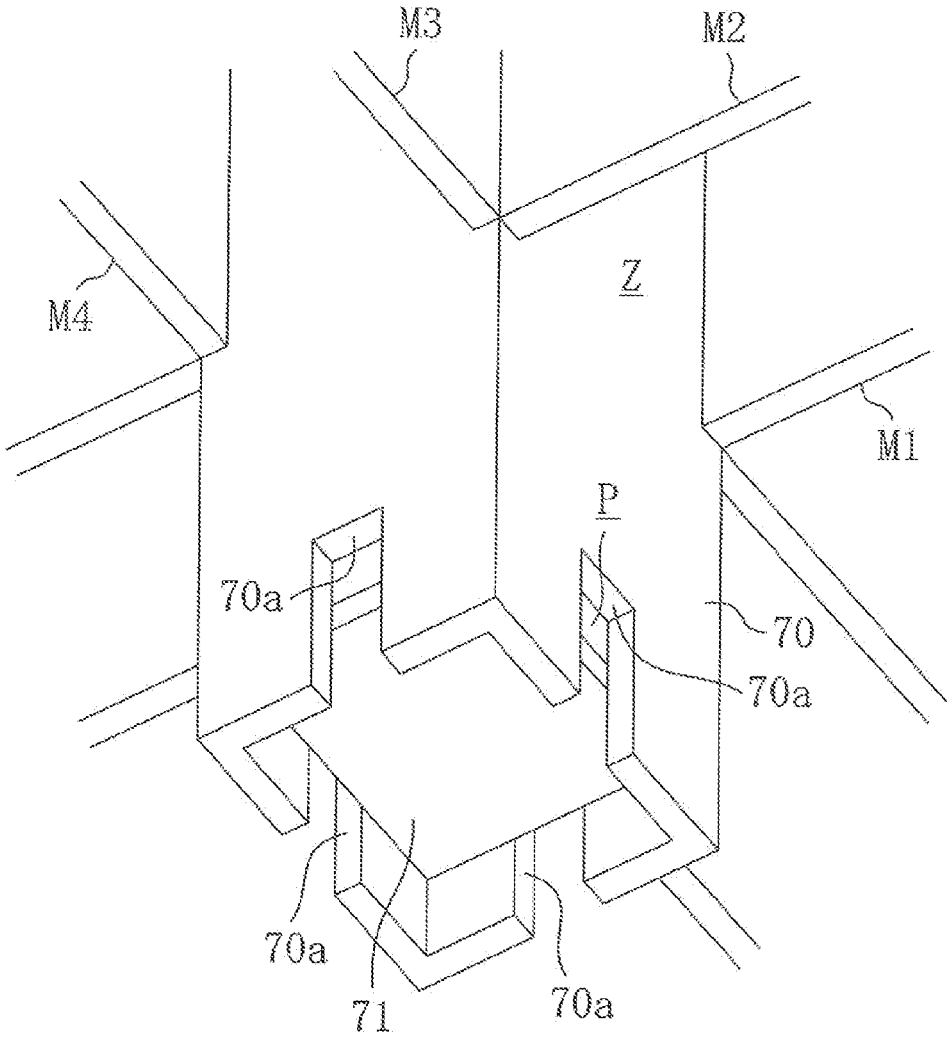
FIG. 23 is a perspective view of portions of ribs near a projection wall when viewed from below.
Figure 24:
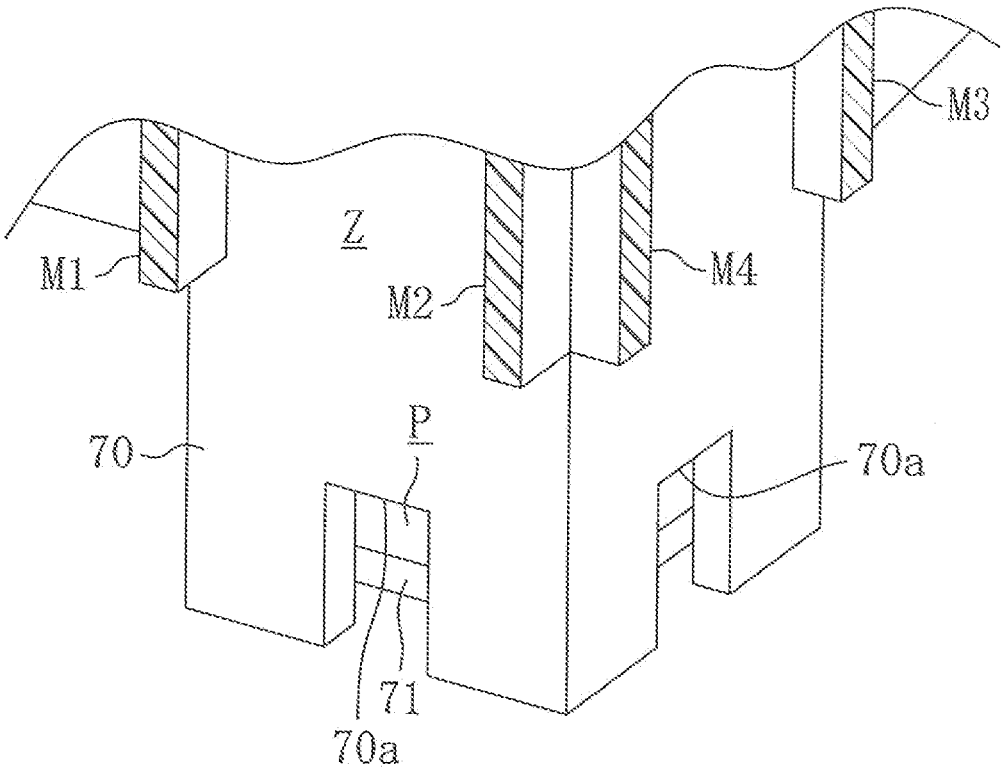
FIG. 24 is a perspective view of portions of ribs near the projection wall when viewed from above.

FIGS. 22-24 illustrate a second embodiment of the present invention. An oil pan 1 according to the second embodiment is different from that of the first embodiment only in that the oil strainer 5 is separated from the oil reservoir 4, and in the structures of the ribs M1 through M4. Thus, in the following description, the same reference numerals denote the same components in the first embodiment, and only different aspects will be described in detail.

Specifically, as illustrated in FIGS. 22 and 23, the oil pan 1 of the second embodiment includes first through fourth main ribs M1 through M4. The first and second main ribs M1 and M2 are spaced apart from each other, and extend substantially in parallel with each other in the front-to-rear direction. The third and fourth main ribs M3 and M4 are spaced apart from each other, and extend substantially in parallel with each other in the right-to-left direction. Intermediate portions of the first and second main ribs M1 and M2 intersect intermediate portions of the third and fourth main ribs M3 and M4. As also illustrated in FIG. 24, these intersections of the ribs M1 through M4 form a rectangular parallelepiped defining a main chamber P.

Portions of the first through fourth main ribs M1 through M4 defining the main chamber P form a projection wall 70 projecting downward from the other portions. The projection wall 70 forms a rectangular parallelepiped, and the bottom thereof is in contact with a bottom wall 2. Four separate notches 70*a*, 70*a*, . . . are formed in lower portions of the projection wall 70. Each of the notches 70*a* extends upward from the lower edge of the projection wall 70. The main chamber P communicates with a sub-chamber Z through the notches 70*a*. The projection wall 70 may have a through hole or a slit extending vertically.

Although not shown, the oil pan 1 also includes auxiliary ribs as in the first embodiment.

A plate 71 extending substantially horizontally in the drawing is disposed in the main chamber P. The plate 71 is located at the middle, in the vertical direction, of the notches 70*a*, and the periphery of the plate 71 is continuous to the inner surface of the projection wall 70. The plate 71 serves as an inner wall of the bottom of the main chamber P, and the bottom wall 2 serves as an outer wall of the bottom of the main chamber P.

In the second embodiment, the bottom of the main chamber P has a double structure made of the plate 71 and the bottom wall 2, thereby enhancing heat insulating properties. Accordingly, in particular, oil in the main chamber P is less likely to be cooled by cold outside air in a cold state, and thus the temperature of oil in the main chamber P can be increased quickly, thereby reducing viscosity.

The oil strainer 5 indicated by virtual lines in FIG. 22 has a cylindrical shape extending vertically, and is located in the main chamber P. A suction port is formed in the bottom of the oil strainer 5, and is located near the plate 71.

As described above, in the second embodiment, the first through fourth main ribs M1 through M4 and the auxiliary ribs in the oil reservoir 4 can increase rigidity of the oil pan 1. In addition, the inside of the oil reservoir 4 is divided into the main chamber P and the sub-chamber Z by the main ribs M1 through M4. Accordingly, it is unnecessary to provide an additional oil pan separator. As a result, the number of components of the engine can be reduced, thereby reducing cost.

A heat insulator may be provided between the plate 71 and the bottom wall 2.

In the foregoing examples of the first and second embodiments, the oil pan 1 is divided into two. However, the present invention is not limited to these examples, and the oil pan 1 may be divided into three or more. The direction of the division of the oil pan 1 is not limited to the vertical direction, and may be the front-to-rear direction or the right-to-left direction.

The oil pan 1 may be formed as one piece.

The present invention is applicable to oil pans for power units such as various engines and automatic transmissions.

INDUSTRIAL APPLICABILITY

As described above, an oil pan according to the present disclosure is suitable for attachment to an engine of an automobile, for example.

What is claimed is:

1. An oil pan made of resin, comprising:

an oil reservoir including a bottom wall and a peripheral wall rising from a periphery of the bottom wall and having an opening at a top of the oil reservoir; and a rib provided in the oil reservoir, wherein the rib extends vertically from the bottom wall to reach the opening and extends across the opening in plan view to join portions of the peripheral wall which are separated from each other along a periphery of the peripheral wall, and the rib divides an inside of the oil reservoir into a main chamber having a suction portion for sucking oil and a sub-chamber.

2. The oil pan of claim 1, further comprising a fastening portion configured to fasten the oil pan and located in a portion of the peripheral wall near the opening of the oil reservoir, wherein the rib extends from a portion near the fastening portion.

3. The oil pan of claim 2, further comprising multiple ones of the fastening portion, wherein the multiple ones of the fastening portion are spaced apart from each other along the periphery of the peripheral wall, and the rib joins portions near the multiple ones of the fastening portion.

4. The oil pan of claim 3, further comprising first, second, and third ribs joining portions near the multiple ones of the fastening portion, and the first, second, and third ribs intersect each other.

5. The oil pan of claim 1, further comprising multiple ones of the rib, wherein the multiple ones of the rib intersect each other to form at least one triangle in plan view.

6. The oil pan of claim 1, wherein the rib is continuous to the bottom wall of the oil reservoir.

7. The oil pan of claim 1, wherein the rib has a through hole configured to establish communication between the main chamber and the sub-chamber.

8. The oil pan of claim 1, wherein the oil pan includes a first part and a second part which are formed as one piece, the rib is provided in each of the first part and the second part, and a gap for establishing communication between the main chamber and the sub-chamber is formed between the rib of the first part and the rib of the second part.

9. The oil pan of claim 1, further comprising an oil strainer provided in the main chamber, wherein the oil strainer includes a filter element and a filter-element housing configured to house the filter element, and the filter-element housing is constituted by the rib.

10. The oil pan of claim 1, further comprising an oil strainer in addition to the oil reservoir, and the oil strainer has a fixing portion to be fixed to the rib.

11. The oil pan of claim 1, wherein the main chamber has a bottom including an outer wall and an inner wall.

12. An oil pan, comprising:

a first part made of resin; and a second part made of resin and formed as a different part from the first part, wherein the first part and the second part are joined together such that an oil reservoir having an opening at a top of the oil reservoir is formed with the first part and the second part, the first part forms an upper portion of the oil pan located above an intermediate portion, in a vertical direction, of the oil pan, and constitutes a portion of the oil reservoir surrounding the opening, the second part forms a lower portion of the oil pan located below the intermediate portion, in the vertical direction, of the oil pan, and constitutes a bottom wall of the oil reservoir, the first part includes a first rib such that the first part and the first rib are formed as one piece, and the first rib extends from the portion of the oil reservoir surrounding the opening to the bottom wall of the second part and is joined to the bottom wall of the second part.

13. The oil pan of claim 12, wherein the second part includes a second rib, and the second rib is joined to the first part.

14. The oil pan of claim 13 comprising an oil strainer including a filter element for filtering oil, and a filter-element housing configured to house the filter element and having a suction port for sucking oil and a discharge port for discharging oil which has passed through the filter element, wherein the filter-element housing includes the first rib and the second rib.

15. The oil pan of claim 12, wherein the first part has a fastening portion configured to fasten the oil pan, and the first rib extends from a portion near the fastening portion.

* * * * *